US005221160A

United States Patent [19]

Azuma et al.

[11] Patent Number: 5,221,160

[45] Date of Patent: Jun. 22, 1993

[54] SUBTERRANEAN CONNECTING METHOD FOR CONSTRUCTION OF SHIELD TUNNEL AND CONNECTING APPARATUS THEREFOR

[75] Inventors: Youji Azuma; Hisao Arai; Kazuo Isaka; Hiroyuki Kubo; Tohru Goto; Tokuharu Nakajima; Akihiro Honda; Kazuo Miyazawa; Toshio Watanabe; Yoshihiko Shimizu; Daizo Tanaka; Nobuhiro Tuchiya; Takao Nakagawa, all of Tokyo; Shigeteru Iba, Kobe; Yoshihiro Ohishi, Takasago; Masahiko Siguyama, Kobe; Kichitaro Tsuji, Tokyo; Shigeru Nishitake, Kobe; Akio Niwa, Tokyo, all of Japan

[73] Assignees: Shimizuo Construction Co.; Mitsubishi Jukogyo Kabushiki Kaisha, both of Japan

[21] Appl. No.: 476,430

[22] PCT Filed: Aug. 26, 1988

[86] PCT No.: PCT/JP88/00854

§ 371 Date: Apr. 26, 1990

§ 102(e) Date: Apr. 26, 1990

[87] PCT Pub. No.: WO90/02246

PCT Pub. Date: Aug. 3, 1990

[51] Int. Cl.[5] ..... E21D 9/06

[52] U.S. Cl. ..... 405/138; 405/141; 405/142; 405/147; 405/150.1

[58] Field of Search ..... 405/138, 141-143, 405/145-147, 150, 150.1

[56] References Cited

U.S. PATENT DOCUMENTS

| | | | |
|---|---|---|---|
| 3,919,851 | 11/1975 | Plourde | 405/146 X |
| 4,432,667 | 2/1984 | Richardson | 405/146 X |
| 5,051,033 | 9/1991 | Grotenhofer | 405/147 |

FOREIGN PATENT DOCUMENTS

| | | | |
|---|---|---|---|
| 95795 | 12/1983 | European Pat. Off. | 405/142 |
| 2838485 | 1/1980 | Fed. Rep. of Germany | 405/147 |
| 62-258095 | 11/1987 | Japan . | |
| 62-258096 | 11/1987 | Japan . | |
| 62-276194 | 12/1987 | Japan . | |
| 62-288298 | 12/1987 | Japan . | |
| 63-7494 | 1/1988 | Japan . | |
| 63-22993 | 1/1988 | Japan . | |
| 63-67395 | 3/1988 | Japan . | |

*Primary Examiner*—Dennis L. Taylor
*Assistant Examiner*—John Ricci
*Attorney, Agent, or Firm*—Scully, Scott, Murphy & Presser

[57] ABSTRACT

A disclosure is made of a subterranean connecting method and a connecting apparatus therefor which are suitable for use when two shield machines are used to excavate a pair of tunnel sections from both ends of a tunnel, and the tunnel sections are connected to each other in mid course. During underground connection, it is important to secure sealing and water retarding with respect to soil and water pressure exerted by the ground in the vicinity of the connecting section. For this purpose, in the connecting apparatus, a penetration ring is arranged in one of the shield machines, and a penetration chamber in which the penetration ring is accommodated is arranged in the other shield machine. Both the both shield machines face each other with a slight gap remaining therebetween and, subsequently, the penetration ring is moved forward and penetrates into the penetration chamber of the mating shield machine. By this penetration, the area between both the shield machines are closed by the penetration ring. In this condition, both the shield machines are disassembled, and the wall surface of the connecting section including the penetration ring is covered, so completing the subterranean connecting step. According to the connection using such a penetration ring, sealing and water retarding with respect to the soil and water pressure in the vicinity of the connecting section can be secured.

14 Claims, 19 Drawing Sheets

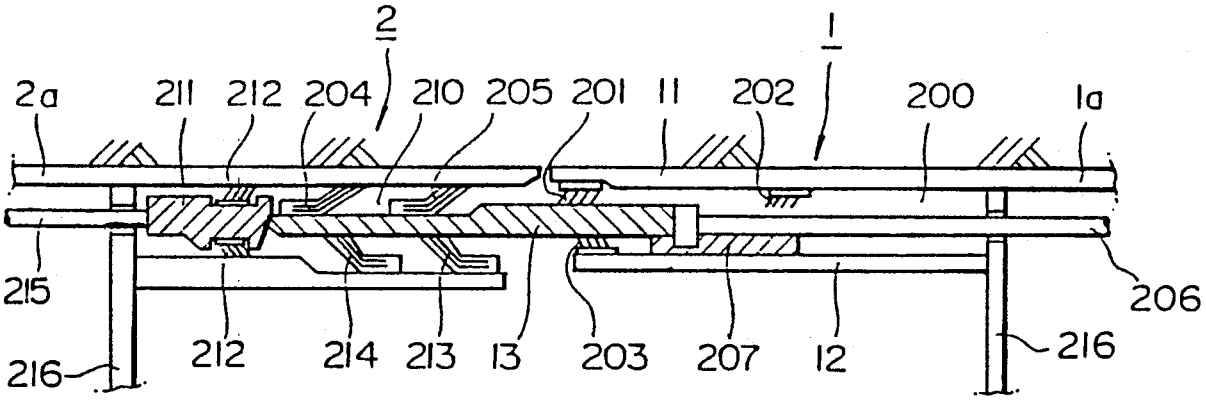
FIG. 11
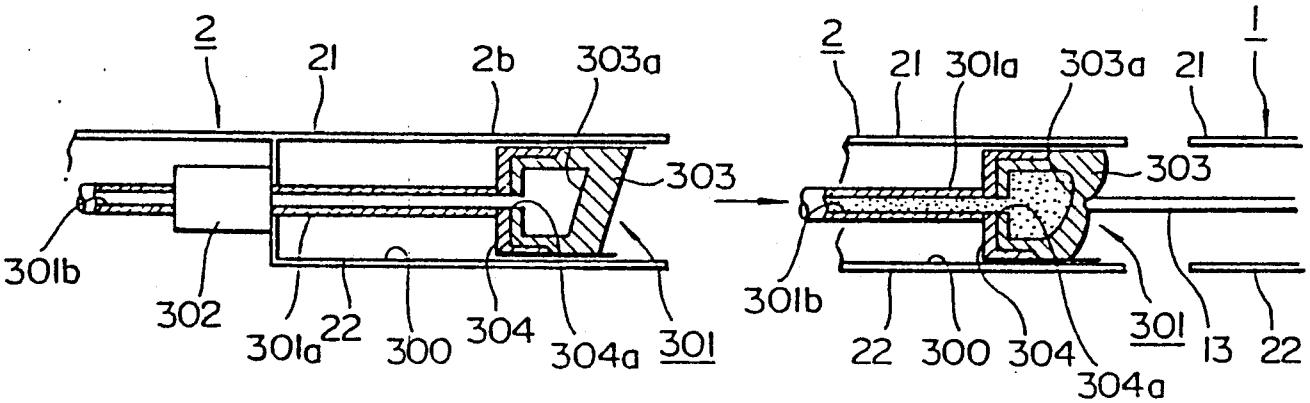
FIG. 12b
FIG. 12a

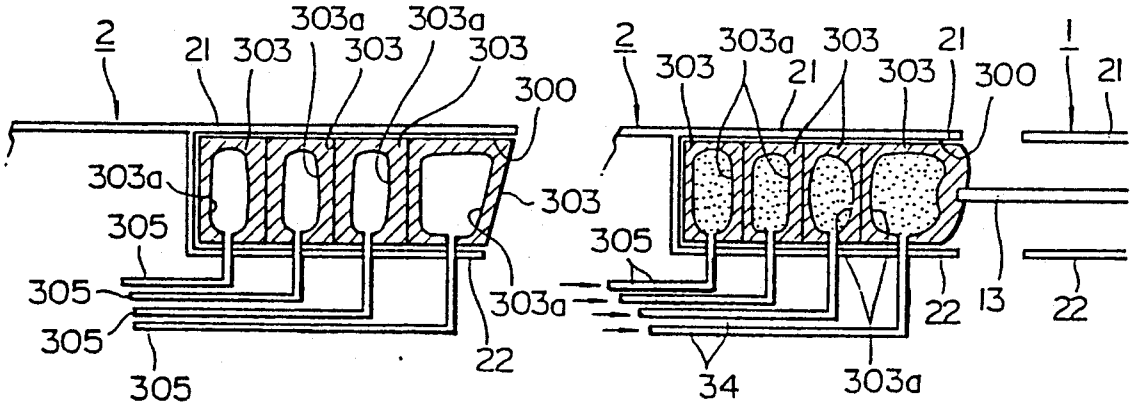
FIG. 13a
FIG. 13b
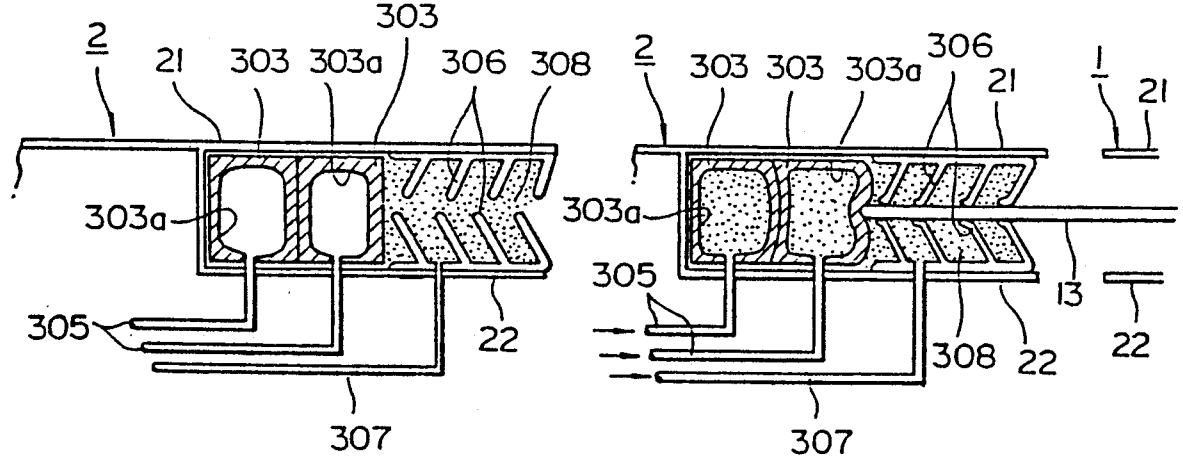
FIG. 14a
FIG. 14b

SUBTERRANEAN CONNECTING METHOD FOR CONSTRUCTION OF SHIELD TUNNEL AND CONNECTING APPARATUS THEREFOR

BACKGROUND OF THE INVENTION

The present invention relates to a subterranean connecting method for construction of a shield tunnel and a connecting apparatus therefor, in which two tunnel sections are excavated by the use of two shield machines simultaneously from the two tunnel sections, and the two tunnel sections are connected to each other to form the single tunnel.

Conventionally, a subterranean connecting method for construction of a shield tunnel of this kind has been known as shown in FIG. 32.

In FIG. 32, the reference character G denotes the ground in the vicinity of a connecting area between two tunnel sections which are excavated from both sides of a shield tunnel. A shield machine 1, which is located on the right side in the drawing sheet and has excavated one tunnel section $T_a$, and a shield machine 2, which is located on the left side and has excavated the other tunnel section $T_b$, face toward each other with the ground $G_i$ having a predetermined spacing (of the order of about 30 cm) remaining. The tunnel sections $T_a$ and $T_b$ formed in rear of the respective shield machines 1 and 2 have their respective wall surfaces which are covered respectively with segments 3*a*, 3*a*, . . . and 3*b*, 3*b*, . . . . A plurality of boring-type freezing tubes 4*a* and 4*b* are arranged within the ground G at the forward ends of the respective shield machines 1 and 2. The boring-type freezing tubes 4*a* and 4*b* are arranged at a predetermined inclined angle (a=17°–25°) with respect to skin plates 1*a* and 2*a* and at a predetermined pitch in the peripheral direction. Plastered freezing tubes (not shown) are also arranged on the entire inner peripheral surfaces of the respective skin plates 1*a* and 2*a* and the segments 3*a* and 3*b* at the foremost locations.

Brine (cooling liquid) is circulated through the boring-type freezing tubes 4*a* and 4*b* arranged at the skin plates 1*a* and 2*a* and through the plastered freezing tubes, whereby the ground $G_f$ at the outer peripheries of the respective skin plates 1*a* and 2*a* is frozen so as to surround the ground $G_i$. Subsequently, the front sections 5*a* and 5*b* of the respective shield machines 1 and 2 are disassembled The ground $G_i$ remaining between the shield machines 1 and 2 is then excavated, and the wall surface of the ground $G_i$ is covered, whereby two tunnel sections $T_a$ and $T_b$ excavated from the left- and right sides are connected to each other. Thus, the shield tunnel is completed.

However, the conventional subterranean connecting method for construction of the shield tunnel has the following drawbacks. First, water sealing and protection against soil collapse are not complete resulting in less safety as both shield machines do not contact to each other forming a gap of normally about 30 cm. Further, a freezing method of construction, which is chiefly employed as an auxiliary method of construction, requires much cost of construction and a long construction time. The strength of frozen ground is reduced due to the mixing of salinity specially in case of the construction under the sea bed. There is an effect or influence of expansion of the frozen ground at freezing and the subsidence of ground at thawing. Control or management of the frozen ground is difficult.

SUMMARY OF THE INVENTION

The invention has been done in view of the above problems, and the object of the invention is to provide a subterranean connecting method for construction of a shield tunnel and a connecting apparatus therefor, which secure water retarding against soil and water pressure acting upon the vicinity of a tunnel connecting section from the ground G in the vicinity of the connecting section so that construction can be done safely, and which can considerably reduce the cost of construction and the construction time required for the connection of tunnels.

In order to achieve the above object, the invention provides a subterranean connecting method for construction of a shield tunnel, comprising the step of excavating two tunnels by a set of shield machines a first shield machine in which a forward end of a skin plate is formed double with an outer tube and an inner tube, and a penetration ring is accommodated between said outer tube and said inner tube, and the second shield machine in which a forward end of a skin plate is formed double with an outer tube and an inner tube which are almost the same in diameter as said first shield machine, and the step of sliding the penetration ring of the said first shield machine forwardly along an axis of the first shield machine just before completion of the tunnel excavation step, and the step of covering the ground at a tunnel connecting section remaining between the said first and second shield machines by the said penetration ring, disassembling the shield machines after completion of the sliding step while the skin plates of the respective first and second shield machines remain, and excavating the ground at the connecting section and, further casting concrete on inner surfaces of the respective skin plates to cover a wall surface of the said connecting section.

Further, according to the invention, there is provided a subterranean connecting method for a shield tunnel, in which two shield machines are used which are propelled underground while the ground is excavated by cutter devices provided respectively at the front sections of the shield machines and while a segment rings for primary covering are assembled in the interior of the excavated ground, and tunnel sections are excavated from both ends of the tunnel to be constructed and are connected to each other on the way to complete the tunnel, comprising the steps of excavating the tunnel by a set of two shield machines having respective forward ends which are formed double with outer tubes and inner tubes, moving the inner tube of one of said two shield machines backwardly just before completion of the tunnel excavating step while moving the inner tube of the other shield machine forwardly with excavating the ground at the connecting section, to close a space between the outer tubes of the respective shield machines by the forwardly moved inner tube, and disassembling the two shield machines after completion of the moving step while skin plates of the respective shield machines remain, to cast concrete on inner surfaces of said skin plates, thereby covering a wall surface of said connecting section.

Moreover, according to the invention, there is provided a subterranean connecting method for construction of a shield tunnel, comprising the steps of excavating tunnel sections by a set of shield machines the first shield machine having a first skin plate whose forward end is provided with a fitting projection and having the first cutter device whose forward edge is formed so retractible as to be capable of being accommodated within said fitting projection, and the second shield machine having the second skin plate formed, at its inside of a forward end with a fitting recess in which said fitting projection is engaged and having the second cutter device whose forward edge is so formed as to be retractible similarly to said first cutter device, subsequently, retracting the forward edges of the respective first and second cutter devices when the tunnel sections are connected to each other, to fit said fitting projection in the fitting recess thereby connecting said first skin plate and said second skin plate to each other to separate the connecting section from the surrounding ground and, subsequently, disassembling said first and second shield machines while the skin plates of the respective first and second shield machines remain as they are, then casting concrete to said fitting section thereby covering a wall surface of said connecting section.

Furthermore, according to the invention, there is provided a subterranean connecting apparatus for a shield tunnel, in which two shield machines are used which are propelled underground while the ground is excavated by cutter devices provided respectively at front sections of the respective first and second shield machines and while segments for primary covering are assembled within the ground, and in which tunnel sections are excavated from both ends of the shield tunnel to be constructed and are connected to each other on the way to complete the tunnel, wherein a skin plate of one of said shield machines has a forward end which is formed double with an outer tube and an inner tube, wherein a penetration ring movable longitudinally of the shield machine is accommodated between the outer tube and the inner tube of the shield machine, and wherein a skin plate of the other shield machine has a forward end which is formed double with an outer tube and an inner tube which are almost the same in diameter as said one shield machine, to form a penetration chamber at the shield machine, said penetration ring being penetrated into said penetration chamber, wherein a protection ring movable longitudinally of the shield machines is accommodated in the penetration chamber, wherein an injection tube is arranged whose forward end opens to the penetration chamber, and wherein an injection bore is formed in said protection ring, said injection bore extending through said protective ring longitudinally of the shield machine.

BRIEF DESCRIPTION OF THE DRAWINGS

FIGS. 10 and 11 are schematic cross-sectional views for explanation of another embodiment of the subterranean connecting method for construction of the shield tunnel, according to the invention;

FIGS. 12 through 14 are schematic cross-sectional views for explanation of examples of a water sealing method at a connecting section by the subterranean connecting apparatus for the shield tunnel, according to the invention;

DESCRIPTION OF THE PREFERRED EMBODIMENTS OF THE INVENTION

Figure 32:
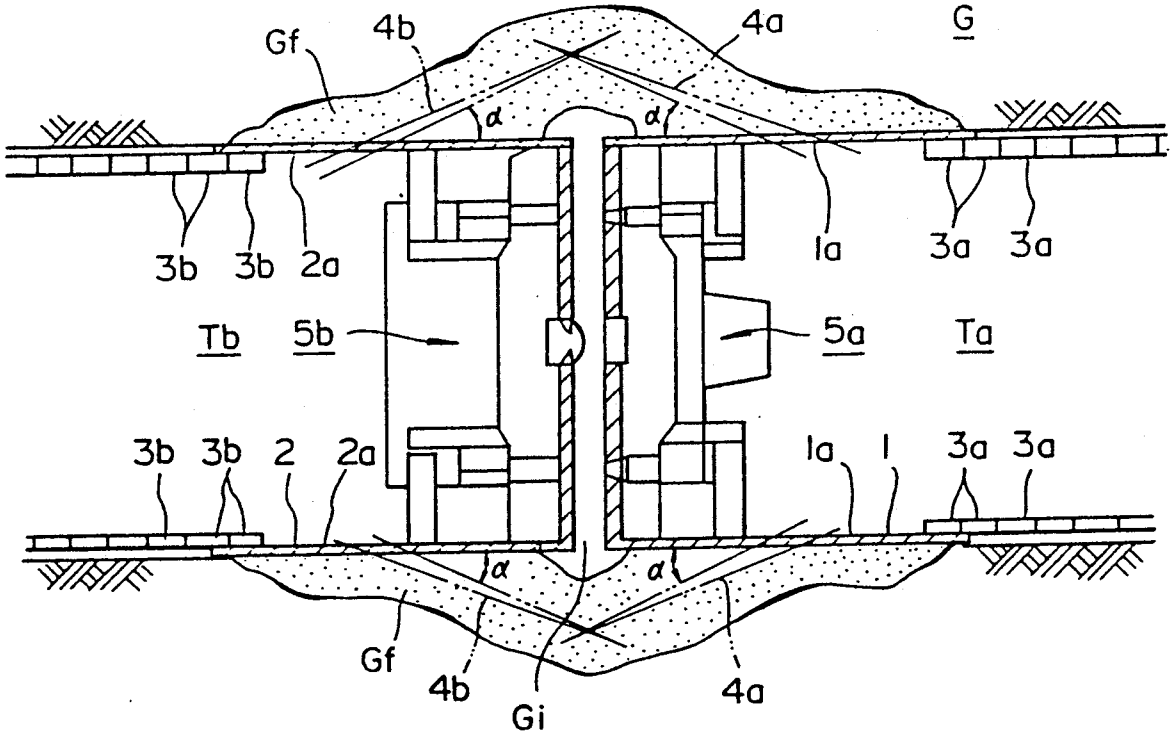
FIG. 32 Prior Art
FIG. 32 is a view showing a condition of a tunnel connection by a freezing method of construction that is the conventional subterranean connecting method for construction of a shield tunnel.

Embodiments of the invention will be described below with reference to the drawings. FIGS. 1 through 4 are schematic explanatory views for explanation of an embodiment of a subterranean connecting method for construction of a shield tunnel, in step order, according to the invention. In these figures, the same elements as the constitutional elements shown in FIG. 32 are designated by the same reference numerals.

In the figures, a first shield machines 1 excavates a first tunnel section $T_a$ within ground G on the right side of the drawing, by a cutter device 10 which is provided at the forward section of the first shield machine 1. The second shield machine 2 excavates the other tunnel section $T_b$ on the left side by a cutter device 20 which is provided at the front section of the second shield machine 2. The tunnel section $T_a$ formed in rear of the shield machine 1 has a wall surface which is primarily covered with a plurality of segments 3*a*, 3*a*, . . . which are assembled within the shield machine 1. The tunnel section $T_b$ formed in rear of the shield machine 2 is primarily covered with a plurality of segments 3*b*, 3*b*, . . . which are assembled within the shield machine 2.

The first shield machine 1 is provided with a skin plate 1*a* which is formed into a cylindrical shape and which forms the outer shell of the body of the shield machine 1. The skin plate 1*a* has a forward section 1*b* which is formed double with an outer tube 11 formed to have almost the same diameter as the skin plate 1*a* and an inner tube 12 formed to have a diameter smaller than that of the outer tube 11. A cylindrical penetration ring 13 is accommodated between the outer tube 11 and the inner tube 12. The penetration ring 13 has a rearward end which is formed with a bulge section 13*a*. The space between the outer tube 11 and the inner tube 12 is filled with a water retarding agent high in viscosity such as rubberized asphalt, grease or the like. By this water retarding agent, a water sealing means is formed between the outer tube 11 and the inner tube 12. A bulkhead plate 14, so formed as to extend perpendicularly to the axis of the shield machine 1, is arranged within the inner tube 12. The inner tube 12 and the skin plate 1*a* are connected to each other by a ring-shaped pressure support plate 15 which is so formed as to extend perpendicularly to the axis of the shield machine 1. The pressure support plate 15 has a front face to which a plurality of extrusion jacks 17, 17, . . . are mounted in the peripheral direction of the front face. The extrusion jacks 17 have respective acting ends 17*a* which abut against the rear face of the penetration ring bulge section 13*a*. Further, the pressure support plate 15 has a rear face to which a plurality of propulsion jacks 18, 18, . . . are mounted in the peripheral direction of the rear face. The propulsion jacks have respective acting ends 18*a* which abut against the side face of the segment 3*a* at the forward end.

The cutter device 10 provided at the forward section of the first shield machine 1 is formed to have a diameter slightly smaller than that of the inner tube 12. A shaft body 19 of the cutter device 10 is supported at the bulkhead plate 14 in the shield machine 1. The cutter device 10 has edge cutter section 10*a* which is extendible and retractible in the radial direction of the shield machine 1.

The second shield machine 2 is provided with a skin plate 2*a* which is formed into a cylindrical shape having a diameter the same as that of the first skin plate 1*a*. The skin plate 2*a* has a forward end section 2*b* which is formed double with an outer tube 21 formed to have almost the same diameter as the skin plate 2*a* and an inner tube 22 formed to have a diameter smaller than that of the outer tube 21, similarly to the first shield machine 1. The space between the outer tube 21 and the inner tube 22 is filled with a water retarding agent high in viscosity such as rubberized asphalt, grease or the like. By this water retarding agent, a water sealing means is formed between the outer tube 21 and the inner tube 22. The inner tube 22 has an interior which is provided with a bulkhead plate 24 so formed as to extend perpendicularly to the axis of the shield machine 2. The inner tube 22 and the skin plate 2*a* are connected to each other by a ring-shaped pressure support plate 25 which is so formed as to extend perpendicularly to the axis of the shield machine 2. Further, a ring 23 is arranged within the interior of the skin plate 2*a*. The ring 23 has a rear face to which a plurality of propulsion jacks 28, 28, . . . are mounted in the peripheral direction of the rear face. The propulsion jacks 28 have respective acting ends 28*a* which abut against the side face of the segment 3*b* at the forward end.

The cutter device 20 provided at the forward section of the second shield machine 2 is formed to have a diameter slightly smaller than that of the inner tube 22. The cutter device 20 has a shaft body 29 which is supported by the bulkhead plate 24 of the shield machine 2. The cutter device 20 has edge cutter sections 20*a* which is extendible and retractible in the radial direction of the shield machine 2, similarly to the cutter device 10.

Further, mud injection pipes 16 and 26 are arranged respectively in the first and second shield machines 1 and 2. The pipes 16 and 26 have respective opening ends which are located respectively at the forward sections of the respective shield machines 1 and 2.

The subterranean connecting method of construction according to the invention will next be described with reference to FIGS. 1 through 4.

Figure 1:
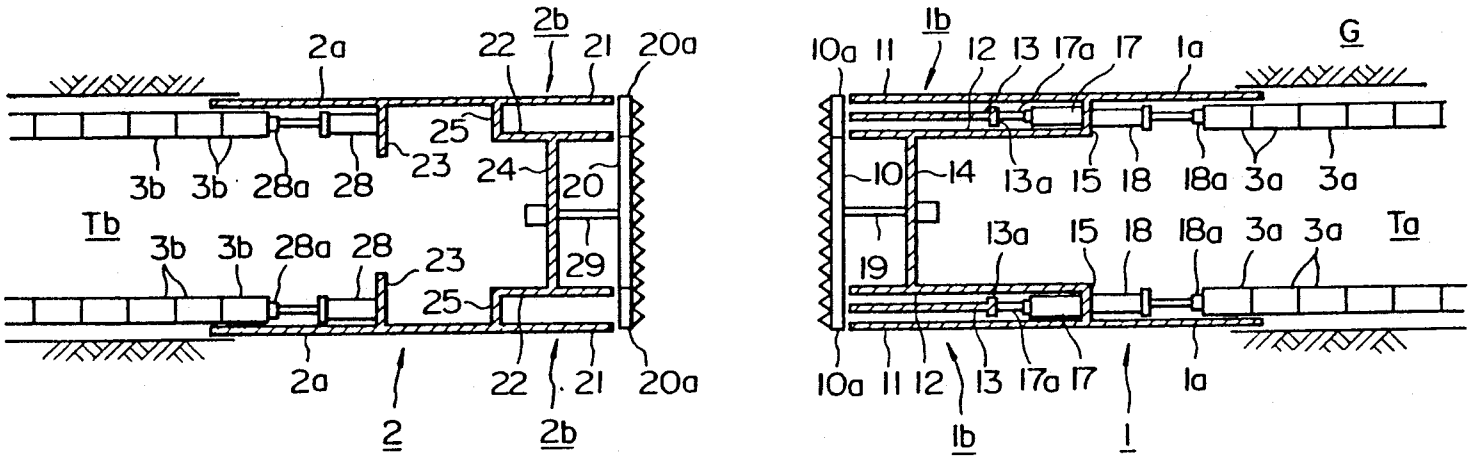
FIGS. 1 through 4 are schematic cross-sectional views for explanation of an embodiment of a subterranean connecting method for construction of a shield tunnel, in step order, according to the invention.

(i) The first shield machine 1 is first used to excavate the ground G by the cutter device 10 from the right side in FIG. 1. The wall surface of the hole excavated is covered with the segments 3*a*, 3*a*, . . . . The propulsion jacks 18, 18, . . . take reaction forces against the respective segments 3*a*, 3*a*, . . . , whereby the one tunnel section $T_a$ is constructed. At this time, the extendible and retractible cutter section 10*a* of the cutter device 10 is extended such that the cutter device 10 can excavate a tunnel section at least equal to the diameter of the outer tube 11. Simultaneously, the second shield machine 2 is used to excavate the ground G by the cutter device 20 from the left side in FIG. 1. The wall surface of the hole excavated is covered with the segments 3*b*, 3*b*, . . . . The propulsion jacks 18, 18, . . . take reaction forces against the respective when the said penetration ring has been inserted into the outer peripheral surface of the forward end of the inner tube of the penetration chamber segments 3*a*, 3*a*, . . . , respectively, thereby constructing the other tunnel section $T_b$. At this time, the extendible and retractible cutter section 20*a* of the cutter device 20 is extended such that the cutter device 20 can excavate a tunnel section at least equal to the diameter of the skin plate 2*a*. (FIG. 1)

Figure 2:
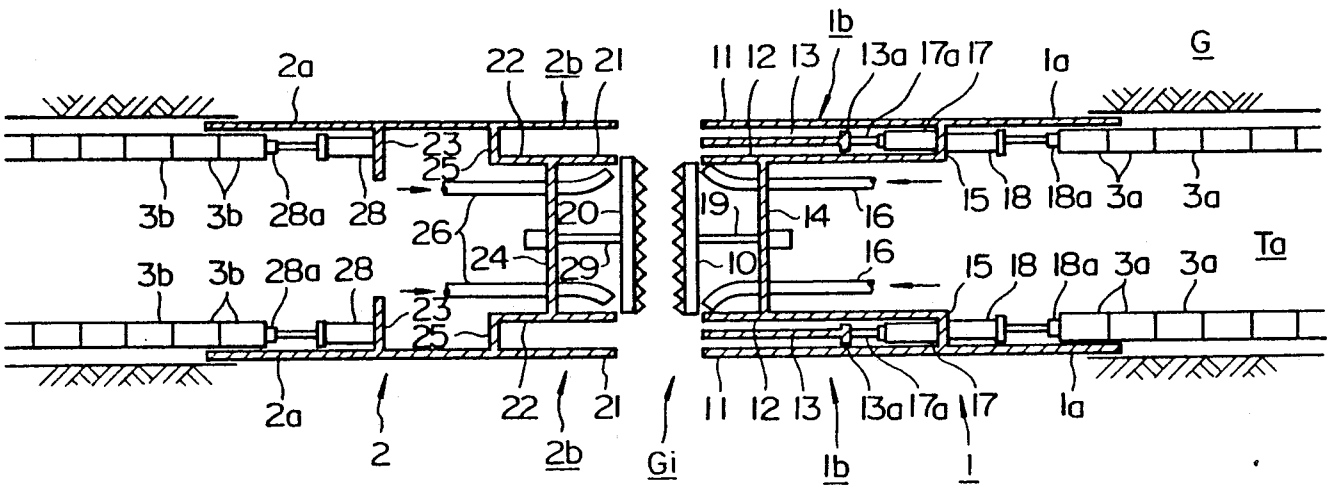

The first shield machine 1 and the second shield machine 2 face toward each other at the connecting section of the tunnel with the ground $G_i$ having a predetermined length (of the order of about 30 cm B !AA 1 m) remaining. At this time, the extended cutter sections 10*a* and 20*a* are retracted to their respective original lengths. Here, since the cutter devices 10 and 20 are formed to have their respective diameters slightly smaller than those of the inner tubes 12 and 22, retraction of the cutter sections 10*a* and 20*a* permits soils to come into the shield machines 1 and 2 respectively from the gaps between the inner tubes 12 and 22 and the cutter devices 10 and 20. In view of this, mud is injected into the ground $G_i$ at the tunnel connecting section by the pipes 16 and 26, to prevent invasion of the soils and to prevent subsidence of the ground $G_i$. (FIG. 2)

Figure 3:
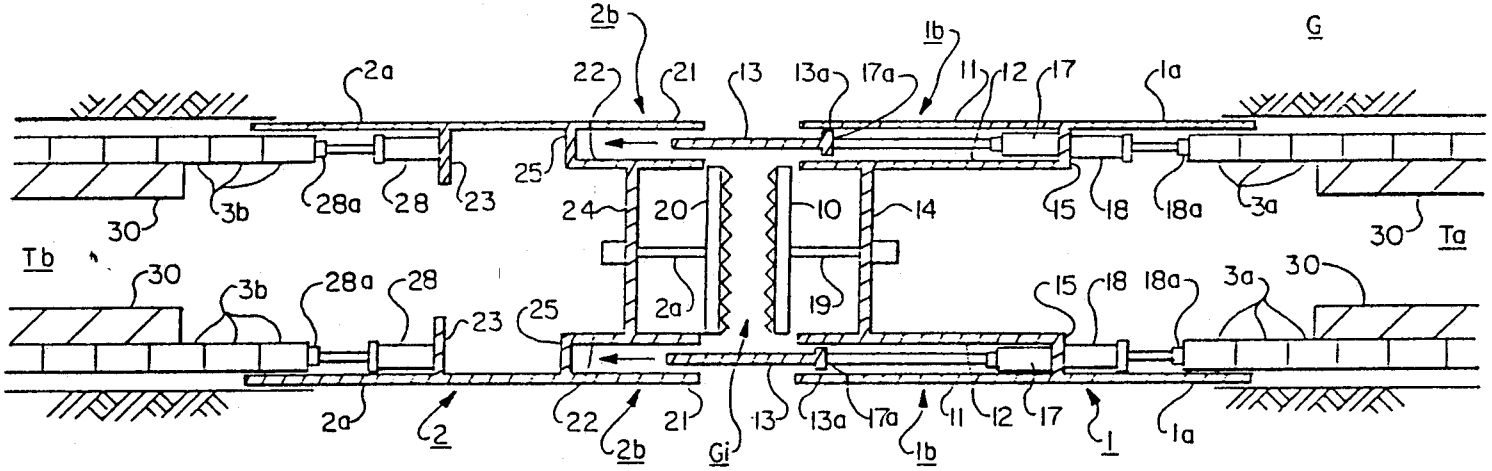

(ii) Next, the extrusion jacks 17 of the first shield machine 1 are driven to slide the penetration ring 13 forward along the axis of the shield machine 1 until the forward end of the penetration ring 13 is inserted into the gap between the outer tube 21 and the inner tube 22 of the second shield machine 2. By doing so, the penetration ring 13 covers the ground $G_i$ at the tunnel connecting section which remains between the first shield machine 1 and the second shield machine 2. Here, the rubberized asphalt or grease filled between the outer tubes 11 and 21 and the inner tubes 12 and 22 is oozed out into the ground $G_i$ at the connecting section from the gap between the skin plates 1*a* and 2*a* in accordance with extrusion of the penetration ring 13. Accordingly, by the oozing-out of the rubberized asphalt or grease, it is possible to further secure water retarding with respect to the ground $G_i$ at the connecting section. Moreover, in the case when the secondary covering is performed with respect to the tunnel sections $T_a$ and $T_b$, concrete is beforehand placed on the inner surfaces of the segments 3*a* and 3*b* up to a location in the vicinity of the connecting section, before covering the tunnel connecting section. (FIG. 3)

Figure 4:
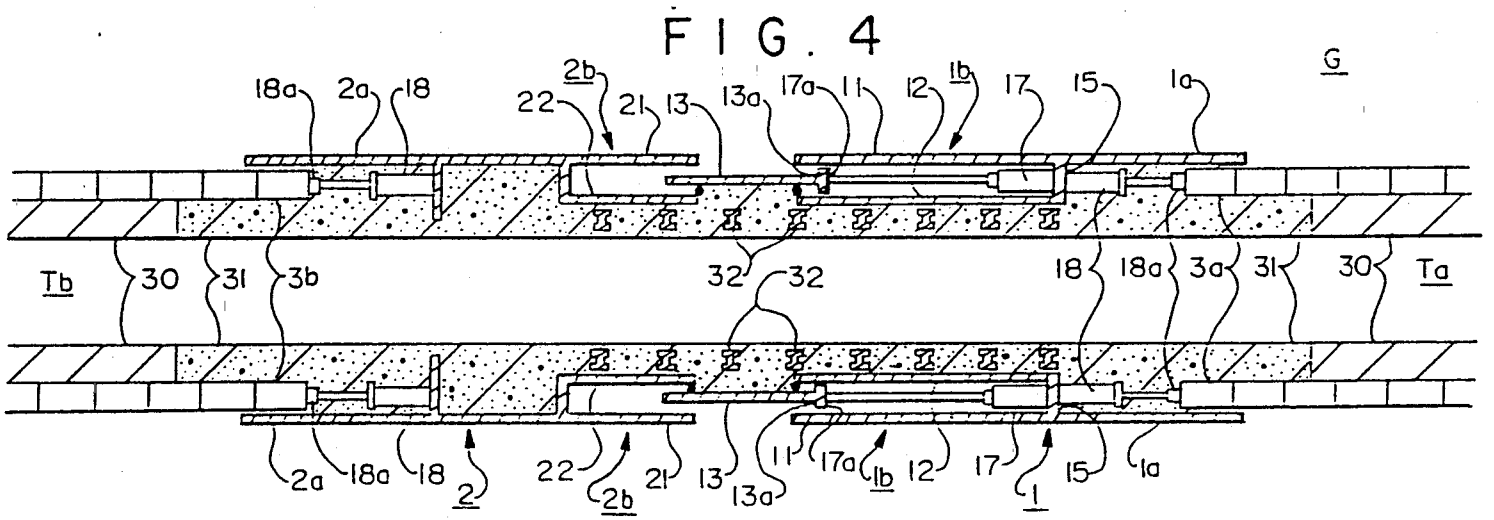

(iii) The cutter devices 10 and 20 are disassembled and removed, and the bulkhead plates 14 and 24 are cut and removed. Further, the both ends of the penetration ring 13 are welded respectively to the inner tubes 12 and 22. Subsequently, cast-in-place concrete 31 including the thickness corresponding to the secondary covering is placed on the inner wall surfaces of the respective skin plates in such a way as to continue on from the covered concrete 30, thereby covering the wall surface of the connecting section. Here, for the purpose of reinforcing the tunnel connecting section, supports 32 made of H-shaped steel, etc. may be placed on the inner surfaces of the respective inner tubes 12 and 22. (FIG. 4)

By the above-described method of construction, operations of the connecting section of the shield tunnel has been completed. Here, since the ground $G_i$ at the tunnel connecting section is covered by the penetration ring 13 which is provided at the skin-plate forward section 1*b* of the first shield machine 1, soil fastening and water sealing of the connecting section are effected by the penetration ring 13. Accordingly, without the use of the auxiliary method of construction as is in the conventional freezing method of construction, it is possible to execute the connecting section of the shield tunnel. Further, without requiring much cost of construction and long construction time as is in the conventional freezing method of construction, execution of the connecting section can be done. Thus, soil fastening and water sealing can be secured with respect to the soil and water pressure, which acts upon a location in the vicinity of the connecting section from the ground G in the vicinity of the tunnel connecting section, so that the connection can be done safely. Further, it is possible to considerably reduce the cost of construction and the construction time which are required for connection of the tunnel.

Particularly, in this embodiment, since the water sealing means consisting of the rubberized asphalt or grease is provided between the outer tubes 11 and 21 and the inner tubes 12 and 22 of the respective first and second shield machines 1 and 2, water sealing can further be ensured when the ground $G_i$ at the tunnel connecting section is covered by the penetration ring 13. Likewise, since the cutter sections 10*a* and 20*a* extendible and retractible in the peripheral direction are provided in the cutter devices 10 and 20 of the respective shield machines 1 and 2, the excavating diameter is not reduced by the due to double tubes of the forward sections 1*b* and 2*b* of the respective skin plates 1*a* and 2*a*. Thus, it is possible to reduce the propulsion resistance which acts on the shield machines 1 and 2 at excavation of the tunnel.

Further, in this embodiment, since the cutter devices 10 and 20 are formed to have respective diameters which are slightly smaller than the inner tubes 12 and 22 releasing the shaft support of the cutter devices 10 and 20 at the bulkhead plates 14 and 24 enables the cutter devices 10 and 20 to be accommodated in a chamber which is formed by the forward ends of the respective inner tubes 12 and 22 and the bulkhead plates 14 and 24. Accordingly, in the abovementioned step (ii), even if the propulsion jacks 18 and 28 are driven to cause the shield machines 1 and 2 to further approach to each other after contraction of the cutter sections 10*a* and 20*a*, the cutter devices 10 and 20 are not in contact with each other. Thus, the shield machines 1 and 2 further approach each other so that they face toward each other, and water sealing can thereby further be ensured at the tunnel connecting section.

Moreover, in this embodiment, although the penetration ring 13 is slid forwardly by the extrusion jacks 17, the invention should not be limited to this specific arrangement. A mechanism may be used which enables the penetration ring 13 to be slid in opposition to soil water pressure at the connecting section.

FIGS. 5 through 9 show an embodiment of a subterranean connecting apparatus for a shield tunnel, according to the invention. In these figures, elements the same as the constitutional elements shown in FIGS. 1 through 4 are designated by the same reference numerals.

In the subterranean connecting apparatus used here, seal elements 100 and 100 such as lip seal elements, U-seal elements, O-rings or the like for sealing the gaps between the penetration ring 13 and the outer tube 11 and the inner tube 12 of the shield machine 1 are provided at the forward ends of the outer and inner tubes 11 and 12. A plurality of rods 101*a*, 101*a*, . . . extendible along the axis of the shield machine 1 are provided with intervals in the peripheral direction of the penetration ring 13 at the rearward end thereof. These rods 101*a*, 101*a*, . . . extend through the pressure support plate 15 which is provided between the outer tube 11 and the inner tube 12. Rearward ends of the respective rods 101*a*, 101*a*, . . . are connected respectively to plurality of extrusion jacks 101, 101, . . . which are arranged on the inner surface of the skin plate 1*a* with intervals. Further, a slide bearing 102 is interposed between the penetration ring 13 and the inner tube 12. With the construction described above, the penetration ring 13 is so arranged as to be slidable longitudinally along the axis of the shield machine 1.

On the other hand, an injection tube 104 is arranged within a penetration chamber 103 which is surrounded by the outer tube 21 and the inner tube 22 of the shield machine 2 and the pressure support plate 25. The injection tube 104 has a forward end which opens to the penetration chamber 103. A protection ring 105 formed to have its thickness slightly smaller than the gap between the outer tube 21 and the inner tube 22 is fitted in such penetration chamber 103. The injection bores 106, 106, . . . extending longitudinally of the second shield machine 2 are formed in the protection ring 105. An inclined surface 107 inclined rearwardly toward the center of the shield machine 2 is formed at the forward face of the protection ring 105. By doing so, provision is made for closer contact between the protection ring 105 and the penetration ring 113 and smoother removal of excavated soil the rods 108*a*, 108*a*, . . . extending along the axis of the shield machine 2 are provided at the rearward end of the protection ring 105 with intervals to each other in the peripheral direction of the protection ring 105. These rods 108*a*, 108*a*, . . . are so provided as to extend through the pressure support 25, and have respective forward ends which are connected respectively to the extrusion jacks 108, 108, . . . provided on the inner surface of the skin plate 21 with intervals to each other in the peripheral direction. By the construction described above, the protection ring 105 is so formed as to be slidable longitudinally along the axis of the shield machine 2.

The injection pipe 104 has a base end which is connected to a plant (not shown) for manufacturing a water retarding material, which is installed toward the rear of the shield machine 2 or on the ground. Thus, it is possible to inject and fill the water retarding material into the penetration chamber 103 through the injection pipe 104. Here, the water retarding material injected through the injection pipe 104 is optional in kind or type, and should suitably be selected from well-known materials. If a cement based water retarding material such as grout is used as the water retarding material, the tunnel connecting section subsequently to be described is built as a permanent structure with the advantage of high durability of the tunnel connecting section.

In connection with the above, the reference numerals 18 and 28 in FIGS. 1 through 4 denote the propulsion jacks which are arranged respectively within the skin plates 1*a* and 2*a* of the respective shield machines 1 and 2 with intervals to each other in the peripheral direction. The propulsion jacks 18 and 28 take reaction forces against the forward ends of the respective segments 3*a* and 3*b* to drive the shield machines 1 and 2 forward. The reference numerals 109 and 110 designate respectively bulkhead plates which are so provided as to close respectively the inner tubes 12 and 22 of the respective shield machines 1 and 2. Also in this embodiment, the cutter devices 10 and 20 for excavating the ground are so formed as to have their respective diameters slightly smaller than those of the inner tubes 12 and 22. The shaft bodies 19 and 29 of the respective cutter devices 19 and 29 are supported respectively by the bulkhead plates 14 and 24. The cutter sections 10*a* and 20*a* extendible and retractible in the radial direction of the shield machines 1 and 2 are provided at the peripheral edges of the respective cutter devices 10 and 20. Further, these cutter devices 10 and 20 are so arranged as to be movable respectively along the axes of the respective shield machines 1 and 2. By doing so, the cutter devices 10 and 20 are capable of being accommodated respectively in the inner tubes 12 and 22 at tunnel connection.

The connecting method for construction of the tunnel using the subterranean connecting apparatus having the construction as above will be described a follows.

Figure 5:
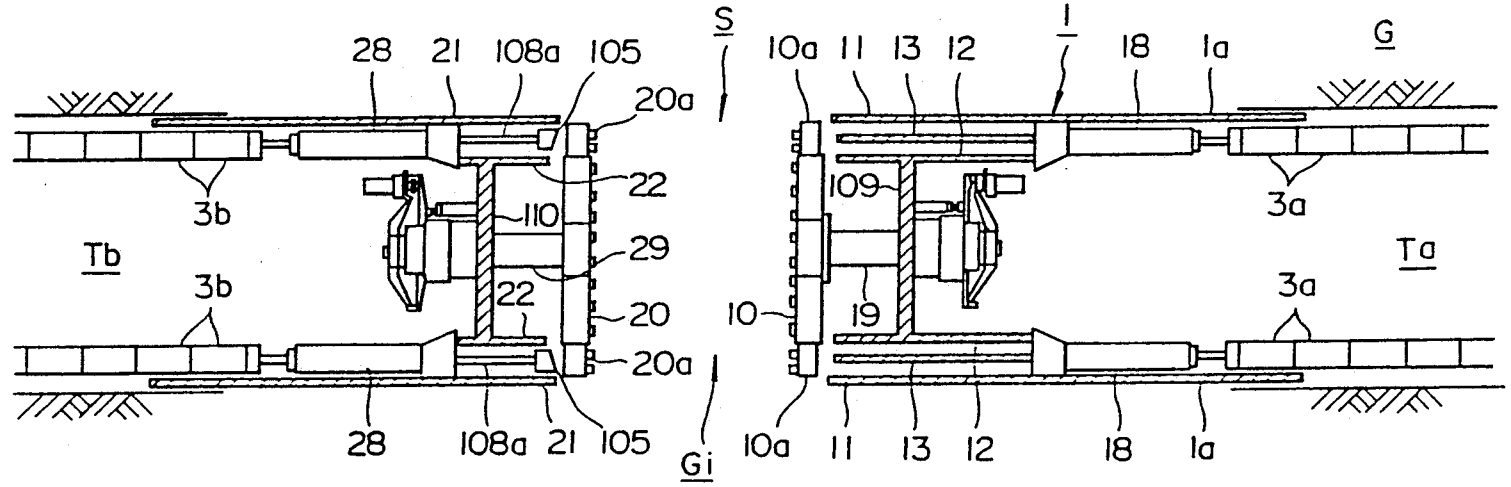
FIGS. 5 through 9 are schematic cross-sectional views for explanation of an embodiment of a subterranean connecting apparatus for a shield tunnel, according to the invention.
Figure 6:
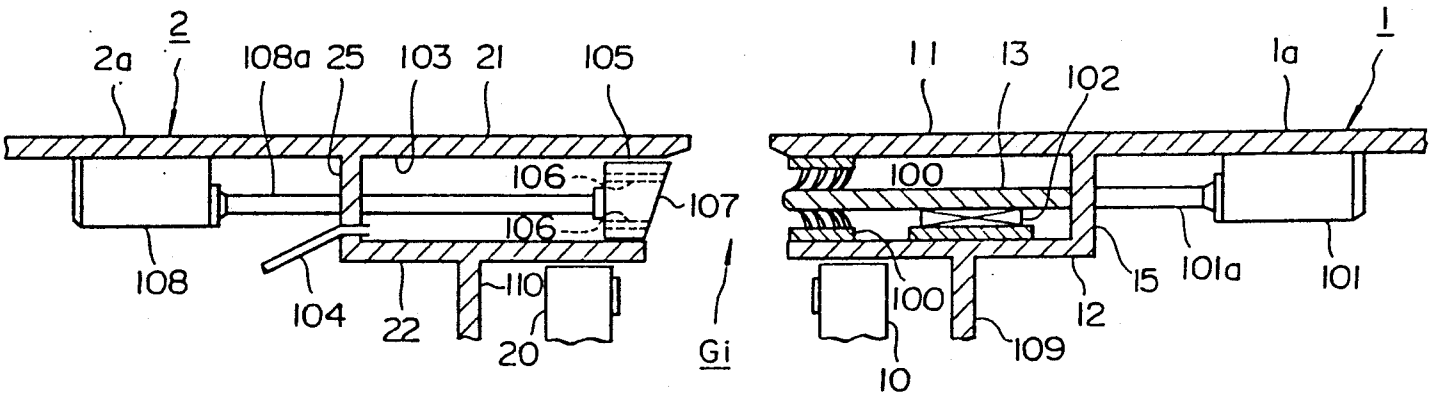
Figure 7:
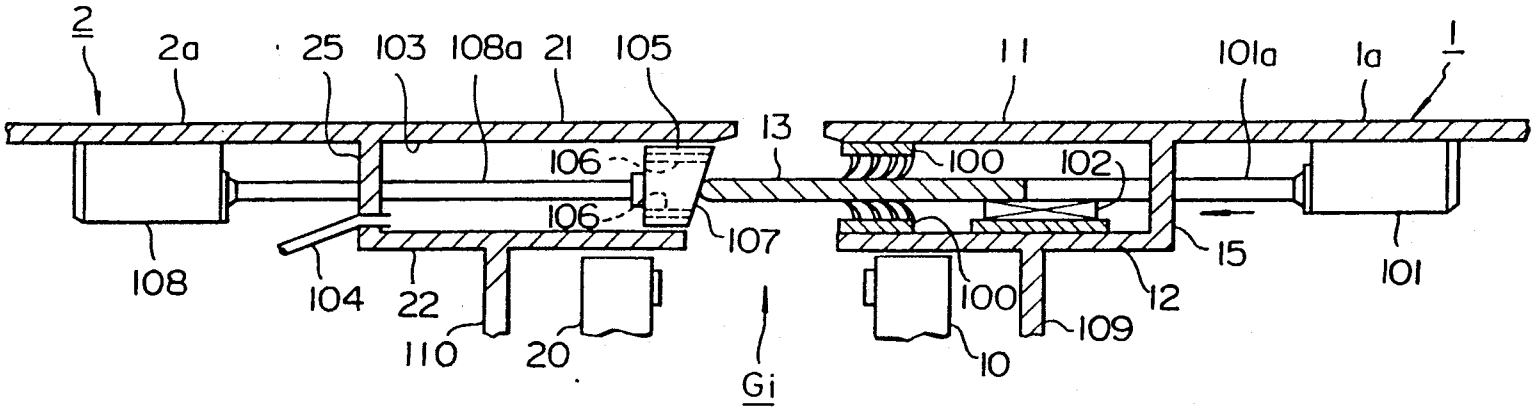
Figure 8:
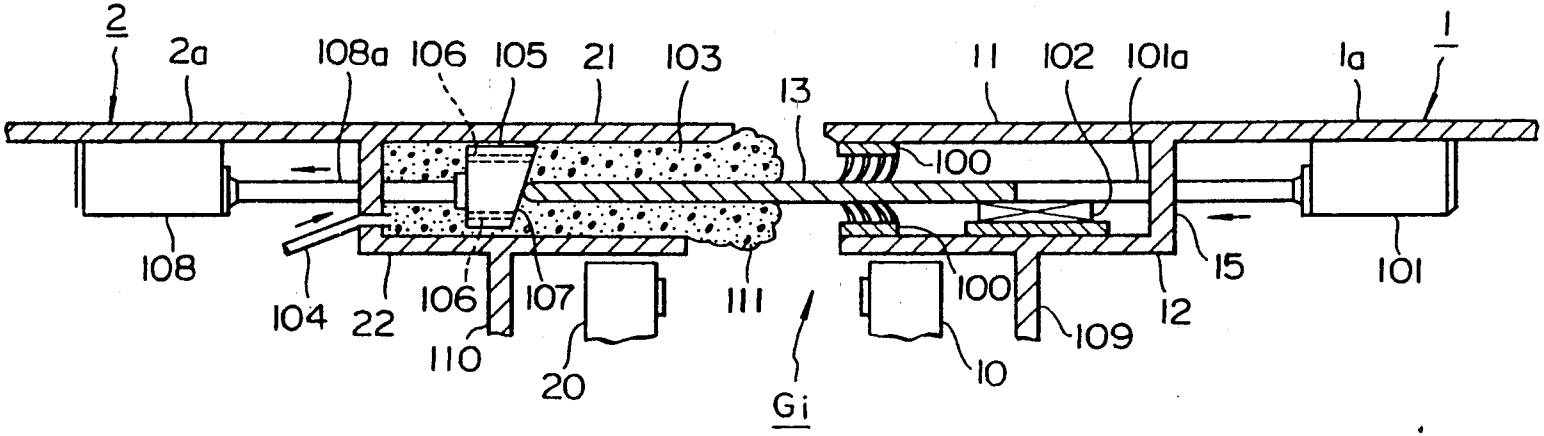
Figure 9:
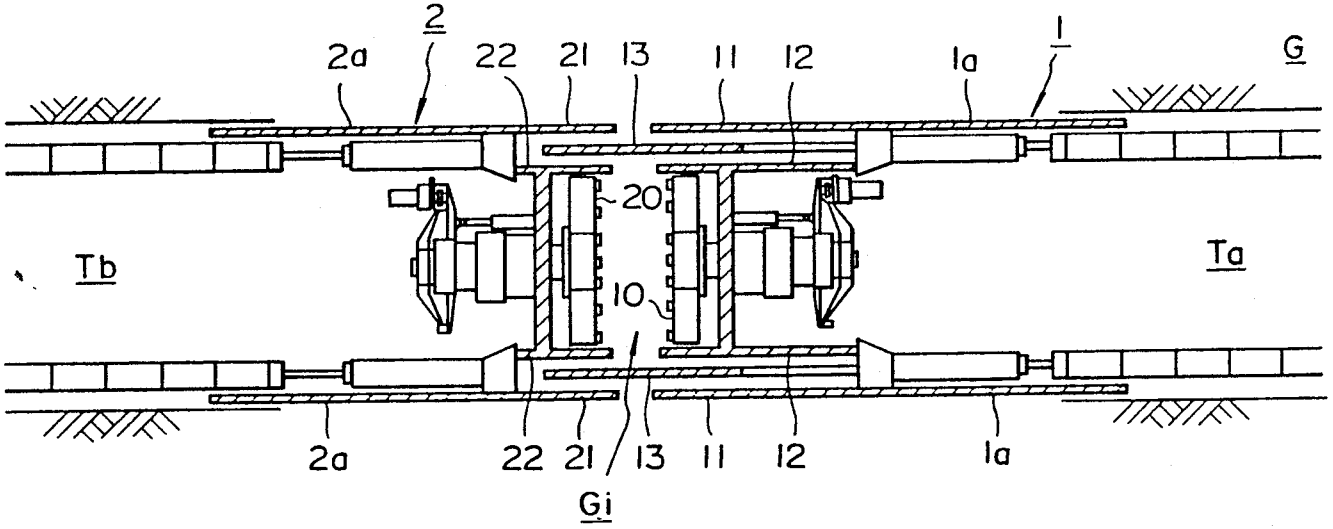

As shown in FIG. 5, the shield machines 1 and 2 are first used to excavate the tunnel sections $T_a$ and $T_b$ from the both ends of the tunnel, while the segments 3*a* and 3*b* are assembled on the wall surfaces of the respective tunnel sections $T_a$ and $T_b$, thereby placing the primary covering. At this time, it is preferable that the cutter sections 10*a* and 20*a* of the respective cutter devices 10 and 20 are extended thereby making the diameters of the excavated respective tunnel sections $T_a$ and $T_b$ at least equal to the outer tubes 11 and 21 respectively. In this connection, the position of the protection ring 105 of the second shield machine 2 within the penetration chamber 103 may be free. If the protection ring 105 is located at the forward position of the penetration chamber 103 upon excavation of the tunnel position $T_b$, however, it is possible to prevent the excavated soil and conglomerate from invading the penetration chamber 103.

The shield machines 1 and 2 face toward each other at the connecting section of the tunnel with the ground $G_i$ having a predetermined length (of the order of about 30 cm–1 m) remaining. The cutter sections 10*a* and 20*a*, which have been extended, are retracted to their respective original lengths. Subsequently, the cutter devices 10 and 20 are accommodated respectively in the inner tubes 12 and 22. Further, the propulsion jacks 18 and 28 are driven to cause the shield machines 1 and 2 to approach each other to such an extent that the forward ends of the respective shield machines 1 and 2 are substantially in abutment with each other. (FIG. 2)

Next, in the case when the protection ring 105 is located at the end of the penetration chamber 103, the extrusion jacks 108, 108, . . . are driven to slide the protection ring 105 to the forward section of the penetration chamber 103, thereby dischanging the soil and conglomerate invading the penetration chamber 103 to the outside. Under this condition, the extrusion jacks 101, 101, . . . are driven to slide the penetration ring 13 forward along the axis of the shield machine 1, so that the forward end of the penetration ring 103 contacts with the protection ring inclined surface 107. (FIG. 3)

Further, extrusion of the penetration ring 13 by the extrusion jacks 101, 101, . . . continues. In accordance with the extrusion, the extrusion jacks 108, 108, . . . are engaged to slide the protection ring 105 rearward while the forward end of the penetration ring 13 is contact with the inclined surface 107. By doing so, the penetration ring 13 is drawn into the back of the penetration chamber 103. That is, by the penetration ring 13, the ground $G_i$ remaining between the shield machines 1 and 2 is covered. Further, simultaneously with the moving operation of the penetration ring 13, the water retarding material 111 is injected and filled into the penetration chamber 103 by the injection tube 104. At this time, a gap is formed in front of the protection ring 105 in accordance with the backward movement of the protection ring 105. Since, however, the injection bores 106, 106, . . . are formed in the protection ring 105 as described previously, the water retarding material 111 reaches a location in front of the protection ring 105 through the injection bores 106, 106, . . . . By doing so, the gap or clearance in front of the protection ring 105 is closed by the water retarding material 111. (FIG. 4)

Subsequently, the cutter devices 10 and 20 are disassembled and removed, and the bulkhead plates 14 and 24 are cut and removed. Further, the both ends of the penetration ring 13 are welded respectively to the inner tubes 12 and 22 and are fixed thereto. Concrete including the thickness of the secondary covering is placed on the inner surfaces of the skin plates 1*a* and 2*a* of the respective shield machines 1 and 2 to cover the tunnel connecting section, thereby completing the operation on the tunnel connecting section.

Thus, according to such a subterranean connecting apparatus, prior to connection between the tunnel sections $T_a$ and $T_b$, it is possible to completely discharge the excavated soil and the like within the penetration chamber 103 by the protection ring 105. Further, the penetration ring 13 is drawn into the penetration chamber 103, and the protection ring 105 is moved rearwardly. By doing so, if the water retarding material 111 is injected and filled in the penetration chamber 103 through the injection tubes 104 simultaneously with the operation covering the ground $G_i$ at the tunnel connecting section, the water retarding material 111 can reach the location in front of the protection ring 105 through the injection bores 106, 106, . . . formed through the protection ring 105, in its turn, the ground $G_i$ at the tunnel connecting section. That is, since it is possible to fill the gap formed in front of the protection ring 105 with the water retarding material 111 in accompaniment with the rearward movement of the protection ring 105, the excavated soil and the conglomerate do not come into the penetration chamber 103 even upon tunnel connection. Thus, it is possible to secure water sealing upon tunnel connection.

Figure 10:
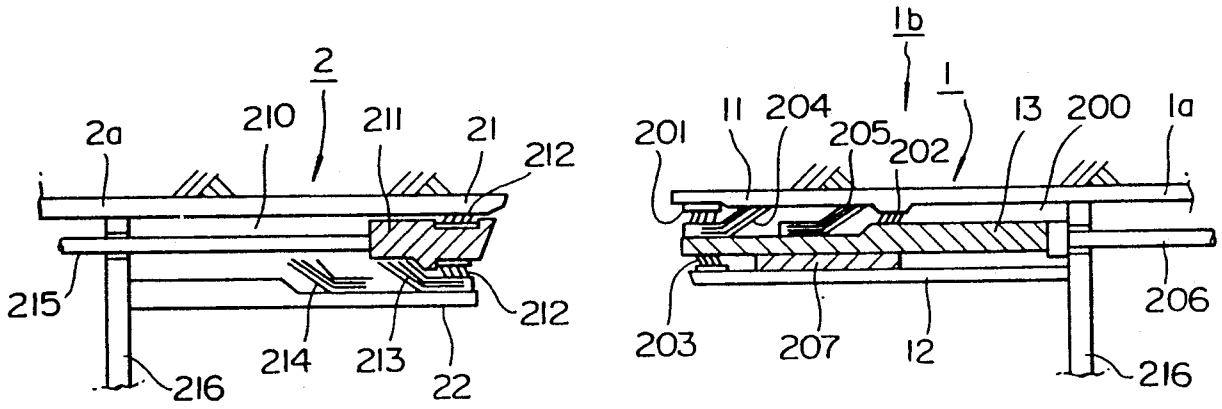

FIGS. 10 and 11 show another embodiment of the subterranean connecting method for construction of the shield tunnel, according to the invention.

In this connecting apparatus, the penetration ring 13 is accommodated in a penetration ring chamber (first shield penetration ring chamber) 200 formed by the outer tube 11 and the inner tube 12 of the shield machine 1, so as to be movable along the axis of the shield machine 1. A pair of lip seal elements 201 and 202 are mounted on the inner peripheral surface of the outer tube 11 respectively at the forward end and the intermediate section thereof. A lip seal element 203 is mounted on the outer peripheral surface of the forward end of the inner tube 12. The penetration ring 13 is so formed that the thickness at its forward end is smaller than that at its rearward end. Its rearward end of the thickness is set with an outer diameter such that the forward end of the lip seal element 202 mounted on the inner peripheral surface of the outer tube 11 is in slidable contact. A pair of brush seal elements 204 and 205 are fixedly mounted respectively to the forward end section and the intermediate section of the outer peripheral surface of the small-thickness section of the penetration ring 13. The penetration ring 13 is under such a condition that its rearward end is connected to a drive device (not shown) by a rod 206. Further, a bearing 207 for slidably supporting the inner side of the penetration ring 13 is fixedly mounted to the central position of the outer peripheral surface of the inner tube 12.

Moreover, in this connecting apparatus, a pressure receiving ring 211 movable along the axis of the shield machine 2 is accommodated at the forward end of the skin plate 2*a* of the shield machine 2 and within a penetration chamber (second shield penetration chamber) 210 formed by the outer tube 21 and the inner tube 22. The inner tube 22 is so formed as to have a rearward end which is thicker than its forward end. The inner tube 22 is so formed that the forward end of a lip seal element 212 mounted on the lower surface of the pressure receiving ring 211 is in slidable contact with the inner tube 22. Further, a lip sealing element 37, whose forward end is in slidable contact with the inner peripheral surface of the outer tube 21, is mounted the upper surface of the pressure receiving ring 211. A pair of brush seal elements 213 and 214 are fixed mounted respectively to the forward end and the intermediate position on the thin wall section of the forward end of the inner tube 22. The lip seal element 212 is under such a condition that the forward end of the lip seal element 212 is in contact with the upper surface of the fixing section of the brush seal element 213. The pressure receiving ring 211 has a forward end which is formed with an inclined surface so as to be in close contact with the forward end of the penetration ring 13. The pressure receiving ring 211 is under such a condition that the rearward end thereof is connected to a drive device (not shown) within the shield machine 2 by a rod 215.

In connection with the above, a mechanism (not shown) for injecting a water retarding material is arranged within the penetration ring chamber 200 and the penetration chamber 210. As the water retarding material injection mechanism, the arrangement may be such that an injection tube is connected to the penetration chamber 210, an injection bore is formed in the pressure receiving ring 211, the water retarding material is injected and filled into the penetration chamber 210 through the injection tube, and the water retarding material within the penetration chamber 210 is injected into the gap in front of the pressure receiving ring 211 through the injection bore formed through the pressure receiving ring 211 in accordance with the rearward movement of the pressure receiving chamber 211, to close the gap.

The operation of the seal structure at the connecting section of the shield machines constructed as above will next be described.

In the case when the shield machine 1 excavates the tunnel section $T_a$, the forward end of the shield machine 1 is sealed by the lip seal elements 201 and 202, and the soil are thereby prevented from invading the penetration ring chamber 200 upon excavation. Further, upon excavation by the shield machine 2, the pressure receiving ring 211 is located in the front of the penetration chamber 210 so that the gap between the inner tube 22 and the outer tube 21 is sealed by the lip seal element 212. Thus, soils are prevented from invading the penetration chamber 210 upon excavation.

In the case when the two shield machines 1 and 2 approach a predetermined location and will be connected to each other, the pressure receiving ring 211 of the second shield machine 2 is first moved rearward toward the rear of the shield machine 2, and the penetration ring 13 of the first shield machine 1 is moved forward. The upper lip seal element 212 is moved rearwardly while being in sliding contact with the inner circumferential surface of the outer tube, in accordance with rearward movement of the pressure receiving ring 211. The lower lip seal element 212 rides over the two brush seal elements 213 and 214, and is accommodated in the penetration chamber 210 while being in sliding contact with the outer peripheral surface of the inner tube within the penetration chamber 210. By doing so, underground water is prevented from invading the shield machine 2 from the section where the rod 215 of the pressure receiving ring 211 passes through the bulkhead plate 216.

Further, the advanced penetration ring 13 penetrates into the penetration chamber 210 while the inner peripheral surface of the penetration ring 13 slides on the upper end surfaces of the respective brush seal elements 213 and 214 of the second shield machine 2. The forward ends of the respective brush seal elements 204 and 205 fixedly mounted to the outer peripheral surface of the penetration ring 13 slide while being in contact with the inner peripheral surface of the outer tube 21. Thus, the penetration ring 13 is brought to such a condition that the penetration ring 13 is fixed to the penetration chamber 210. By doing so, the underground water is prevented from invading the shield machine from the penetration chamber 210. Moreover, the lip seal elements 201 and 203 mounted on the forward end of the penetration ring chamber 200 have respective forward ends which are in contact respectively with the inner and outer surfaces of the thick-wall section of the penetration ring 13, so closing the inlet section of the penetration ring chamber 200. Thus, the underground water is prevented from invading the shield machine from the penetration ring chamber 200.

The forward end of the penetration ring 13 is brought to such a condition as to abut against the forward end of the pressure receiving ring 211 having the inclined surface. After the penetration ring 13 has penetrated into the penetration chamber 210, the water retarding material is injected into the penetration ring chamber 200 and the penetration chamber 210. The brush seal elements 204, 205, 213 and 214 are solidified.by the injection material, which makes the penetration ring 13 penetrated into the penetration chamber 210 be fixed within the penetration chamber 210 and become stable in strength.

According to the seal structure at the connecting section of the shield machines, the lip seal elements 212 and 212, which are slidable with respect to the inner peripheral surface of the outer tube 21 and the outer peripheral surface of the rear section of the inner tube 22, are provided on the inner and outer surfaces of the pressure receiving ring 211. The brush seal elements 213 and 214 slidable with respect to the top of the lip seal element 212 are provided on the outer peripheral surface of the forward end of the inner tube 22. Further, the brush seal elements 204 and 205 are provided on the outer peripheral surface of the penetration ring 13. The lip seal elements 201 and 203 are provided on the inner peripheral surfaces of the forward ends of the respective outer tube 11 and the inner tube 12 of the penetration ring chamber 200. Thus, even if the penetration ring chamber 200 and the penetration chamber 210 of the respective shield machines are formed respectively at the forward ends of the skin plates, soil, conglomerate and the like are prevented from invading the penetration ring chamber 200 and the penetration chamber 210 upon normal or usual excavation. It is possible for the penetration ring 13 to smoothly penetrate into the penetration chamber 210 upon connection. When the penetration ring 13 has penetrated the penetration chamber 210, no gap is formed within the penetration chamber 210. Thus, the water sealing effect can be sufficiently obtained. Further, the forward end of the penetration ring 13 is brought to such a condition as to be fixed by the brush seal elements 204, 205, 213 and 214 which are hardened by the water retarding material within the penetration chamber 210, and the connecting section can become stable in strength.

FIGS. 12 through 14 are views for explanation of examples of the water sealing method of the connecting section of the subterranean connecting apparatus for the shield tunnel, according to the invention.

Firstly, as shown in FIGS. 12(*a*) and 12(*b*), a penetration chamber 300 which is a space formed as an annulus by the outer tube 21 and the inner tube 22 is formed at the forward end 2*b* of the skin plate of the shield machine 2. A pressure receiving ring 301 is provided in the penetration chamber 300, and is mounted on a plurality of jacks 302 which are fixed to the outer side of the penetration chamber 300 respectively through a plurality of rods 301*a*, 301*a*, . . . , which are provided at predetermined intervals in the peripheral direction of the pressure receiving ring 301. The pressure receiving ring 301 is composed of a hollow elastic element 303 made of tube shaped fiber-reinforced hard rubber formed into a ring shape along the peripheral direction of the inner wall of the penetration chamber 300, and a reinforcing steel ring 304 having a C-shaped cross-section which is fixedly mounted to the rear surface of the hollow elastic element 303. The forward end of the rod 301*a* is fixedly mounted to the reinforcing ring 304, and a hollow section 303*a* formed inside of the hollow elastic element 303 is thereby formed so as to connect to a fluid passage 301*b* formed in the rod 301*a*, through a bore 304*a* formed at a predetermined location on the reinforcing ring 304.

When the shield machines 1 and 2 are connected to each other, as shown in FIG. 12(*b*), fluid such as air, water, oil or the like is delivered to the inside of the hollow elastic element 303 of the pressure receiving ring 301 through the rod 301*a*, which makes the hollow elastic element 303 swell. Under such a condition the pressure receiving ring 301 is moved to discharge the soil and conglomerate within the penetration chamber 300 to the outside. Subsequently, the penetration ring 13 of the shield machine 1 penetrates the penetration chamber 300 to makes the forward end of the penetration ring 13 abut against the hollow elastic element 303.

As a result, even in the case when offset or inclination exists between two axes of the respective shield machines 1 and 2, the hollow elastic element 303 made of fiber-reinforced hard rubber is in close contact with the forward end of the penetration ring 13 of the shield machine 1 along the entire periphery without gap so that it is possible to improve the water sealing effect. Further, under such a condition that the penetration ring 13 and the hollow elastic element 303 are pressed into contact with each other, the pressure within the hollow elastic element 303 is raised and it is thereby possible to raise the contact pressure and to obtain an even larger water sealing effect.

Next, FIG. 13 is used to describe another example of the water sealing method at the connecting section of the subterranean connecting apparatus illustrated in FIG. 12. FIGS. 13(*a*) and 13(*b*) show a cross-sectional structure of the penetration chamber 300 of the shield machine 2. A plurality of (four in this embodiment) hollow elastic elements 303, 303, . . . are fitted in the penetration chamber 300, and the penetration chamber 300 is thereby brought to such a condition as to be closed completely. A plurality of conduits 305, 305, . . . for forcibly delivering a fluid such as air, water, oil or the like to the hollow sections 303*a*, 303*a*, . . . of the respective hollow elastic elements 303, 303, are arranged there within.

In this embodiment, during excavation by the shield machine 2, the soil, the conglomerate and the like can be prevented from invading the penetration chamber 300 by the pressure receiving ring 301. When the shield machines 1 and 2 are connected to each other, as shown in FIG. 13(*b*), the fluid is forcibly delivered into the hollow elastic elements 303, 303, . . . , to inflate the pressure receiving rings 301, 301, . . . . In this condition, the penetration ring 13 of the shield machine 1 penetrates the penetration chamber 300 and is made to abut against the forward end of the pressure receiving ring 301.

Next, FIG. 14 is used to describe another example of the water sealing method at the connecting section of the subterranean connecting apparatus illustrated in FIG. 13. In this example, two hollow elastic elements 303 and 303 are arranged at the end of the penetration chamber 300. A water sealing brush 306 formed into an annulus along the inner walls of the penetration chamber 300 is mounted in the forward section of the penetration chamber 300. The water sealing brush 306 has tips extend toward the inward side of the penetration chamber 300. Further, the vacant section on the inside of the water sealing brush 306 is filled with artificial with a small grain size or sand. The conduits 305 and 305 for forcibly delivering fluid such as air, water, oil or the like are arranged at the hollow elastic elements 303 and 303. A grout agent injection pipe 307 is arranged at the water sealing brush 306 in front of the hollow elastic elements 303 and 303, and communicates with the inner surface of the water sealing brush 306.

In this example, when the shield machines 1 and 2 are connected to each other, the penetration ring 13 of the shield machine 1 penetrates the penetration chamber 300, and the forward end of the penetration ring 13 made to is abut against the forward end of the pressure receiving ring 301. The fluid is forcibly delivered to the hollow sections 303*a* within the hollow elastic elements 303 and 303 of the shield machine 2 to inflate the hollow elastic element 303. Subsequently, the chemical grout agent is injected into the inner surface of the water sealing brush 306 through the grout agent injecting pipe 36, to solidify the artificial or sand 308.

Accordingly, in this example, since the gap between the water sealing brush 306 and the penetration ring 13 is closed by the solidified artificial or sand 308, it is possible to obtain a move complete water sealing effect.

Figure 15:
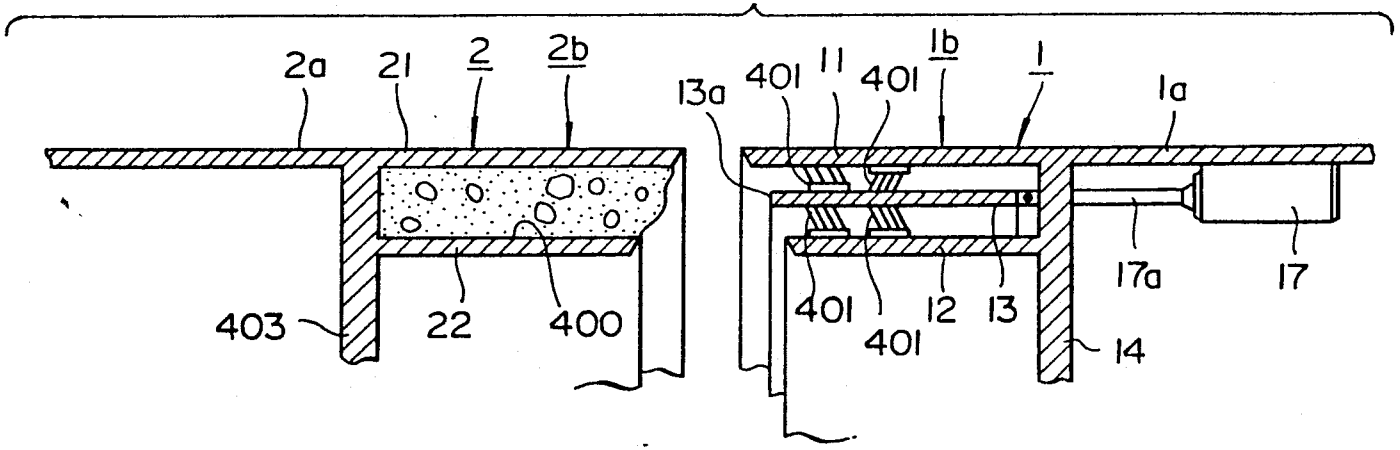
FIGS. 15 through 17 are schematic cross-sectional views for explanation of an example of a penetration method of a penetration ring in the subterranean connecting apparatus for the shield tunnel, according to the invention.
Figure 16:
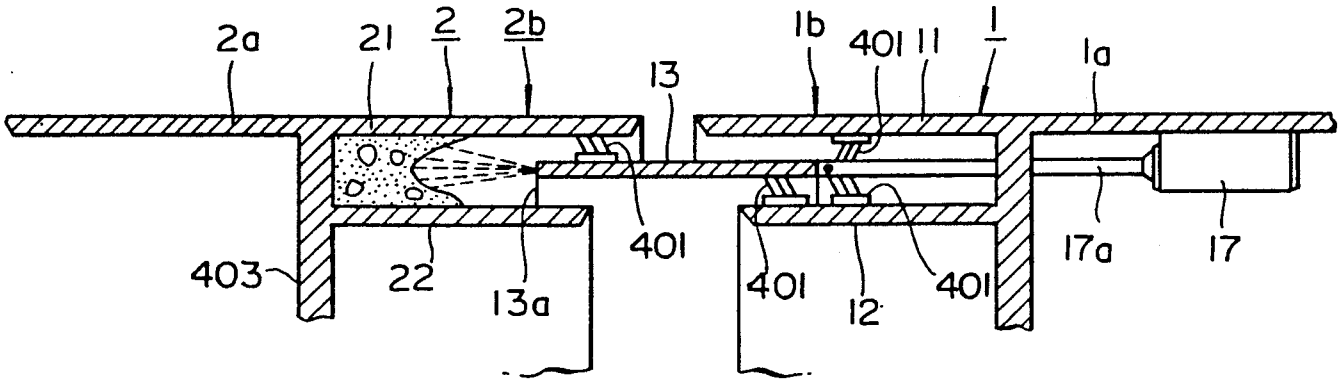

FIGS. 15 and 16 are views for explanation of an example of a penetration method of a penetration ring in the subterranean connecting apparatus for the shield tunnel, according to the invention.

In the subterranean connecting method of construction according to the invention, it is important to discharge soil, conglomerate and the like which are an obstacle to any improvement in water sealing in the tunnel connecting section and to smooth penetration of the penetration ring into the penetration chamber. In the subterranean connecting method of construction in this example, soil, conglomerate and the like which are clogged within a penetration chamber 400 of the shield machine are blasted to the outside by a high-pressure jet injection means and so clean the penetration chamber 400, thereby allowing penetration of the penetrating ring 13 into the penetration chamber 400. That is, at the forward end (the left-hand side with respect to the drawing sheet) 13*a* of the penetration ring 13 in this example, high-pressure jet nozzles (not shown) are arranged at predetermined intervals in the peripheral direction of the penetration ring 13. A high-pressure jet of, for example, water, air or the like supplied from the interior of the shield machine 1 by a predetermined method of construction is injected from the high-pressure jet nozzles. The chemical grout agent for water retarding is injected through the high-pressure jet nozzles. Further, a plurality of seal materials 401, 401, . . . such as lip seal elements, O-ring seal elements, O-rings or the like are mounted on a location between the outer tube 11 and the inner tube 12 and the penetration ring 13.

Upon tunnel connection in the subterranean connecting method of construction using such subterranean connecting apparatus, as shown in FIG. 16, the high-pressure jet is injected from the forward end 13*a* of the penetration ring 13 while the penetration ring 13 is moved forward. As penetration ring 13 is inserted into the penetration chamber 400, the soil, the conglomerate and the like clogged within the penetration chamber 400 during excavation are blasted away by the high-pressure jet so that the interior of the penetration chamber 400 is cleaned, and the cylindrical space within the penetration chamber 400 is thereby secured. In this connection, after the penetration ring 13 has penetrated the penetration chamber 400, the grout agent is injected from the forward end 13 of the penetration ring 13, and water sealing is thereby executed within the penetration chamber 400.

According to the method of construction in this example, in the case where the soil, the conglomerate and the like are clogged within the penetration chamber 400 upon excavation and so block, the the penetration chamber 400 soil, the conglomerate and the like can easily and reliably be removed by the high-pressure jet to secure the space in the penetration chamber 400. Accordingly, it is possible to smoothly insert the penetration ring 13 into the penetration chamber 400. Thus, the water retarding properties at the tunnel connecting section can be considerably improved.

Figure 17:
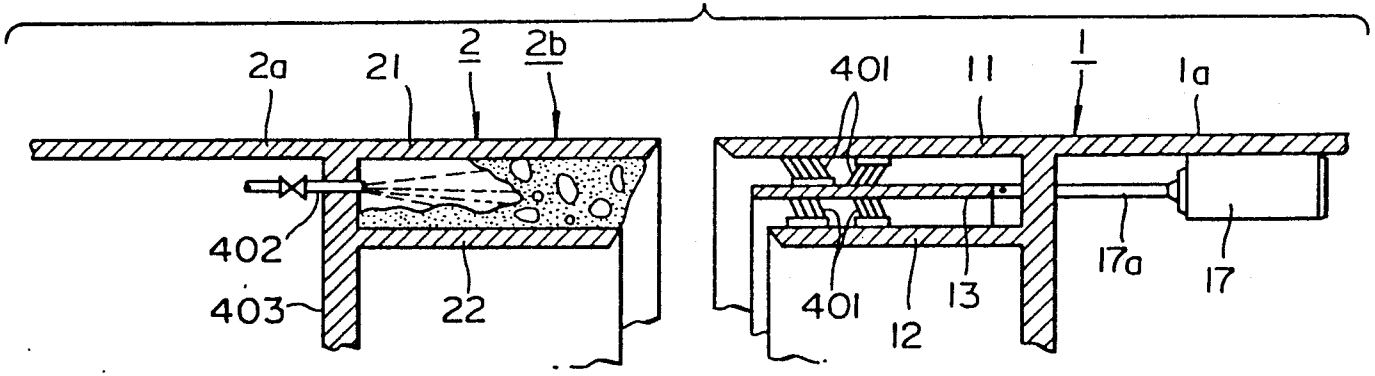

FIG. 17 shows a modification of the high-pressure jet injection means illustrated in FIGS. 15 and 16. In this modification, a plurality of high-pressure jet nozzles 402 are fixed to a partition plate 403 at the end of the penetration chamber 400 of the second shield machine 2, at predetermined intervals along the peripheral direction of the shield machine 2.

In the subterranean connecting method of construction using such a high-pressure jet injection means, soil, conglomerate and the like clogged within the penetration chamber 400 are blasted to the outside by a high-pressure jet injected from the high-pressure jet nozzles 402 at the end of the penetration chamber 400 so cleaning the penetration chamber 400 and thereby securing a space. Subsequently, the penetration ring 13 is inserted into the penetration chamber 400. In this connection, after the penetration ring 13 has penetrated, grout agent is injected from the high-pressure jet nozzles 402 to execute water sealing within the penetration chamber 400.

According to such a subterranean connecting method of construction, since the high-pressure nozzles 402 are arranged within the penetration chamber 400, it is possible to blast away the soil, the conglomerate and the like clogged within the penetration chamber 400. Thus, it is possible for the penetration ring 13 to smoothly penetration to the penetration chamber 400. As compared with the case where the high-pressure jet nozzles are provided at the forward end 13*a* of the penetration ring 13, the construction for supplying the high-pressure jet can be simplified making it possible to provide for a reduction in the cost of construction.

Figure 18:
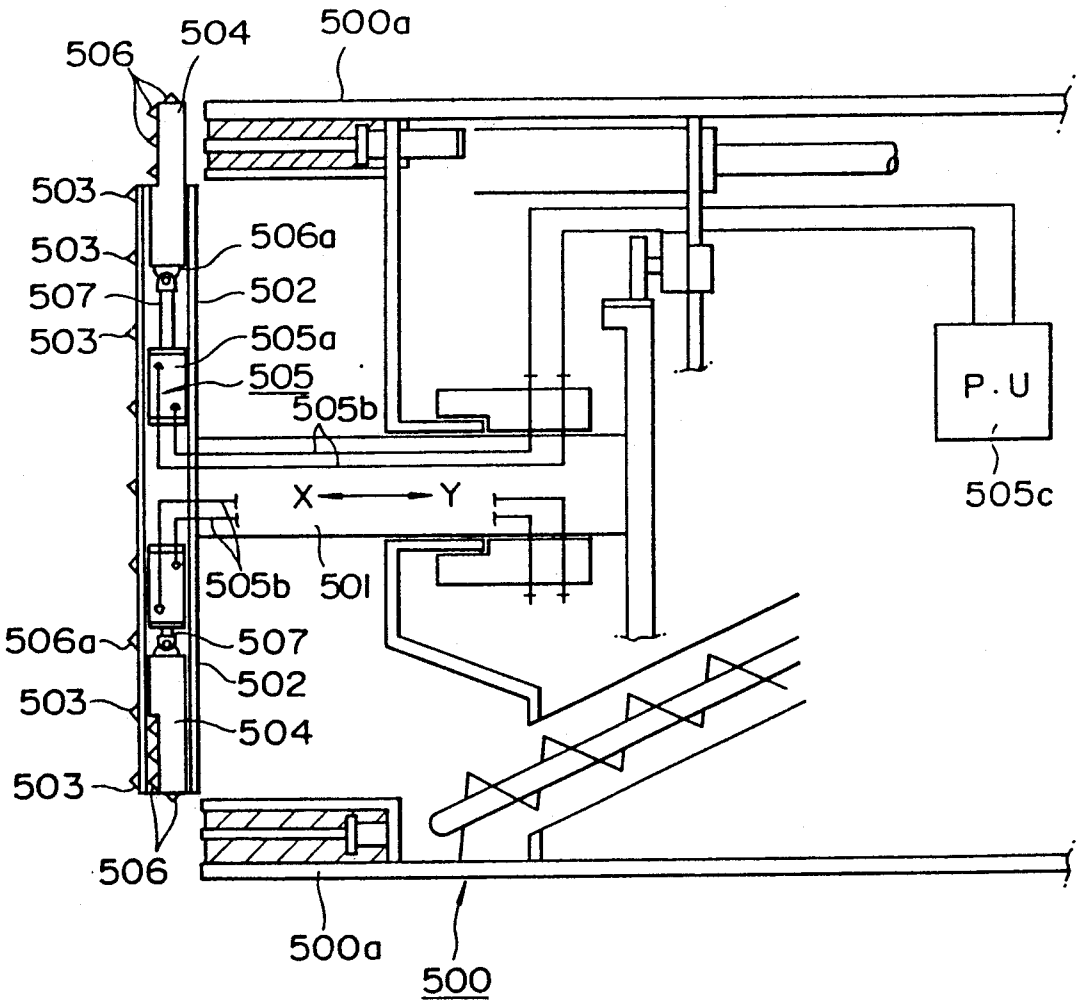
FIGS. 18 and 19 are schematic cross-sectional views showing another example of the subterranean connecting apparatus for the shield tunnel, according to the invention.
Figure 19:
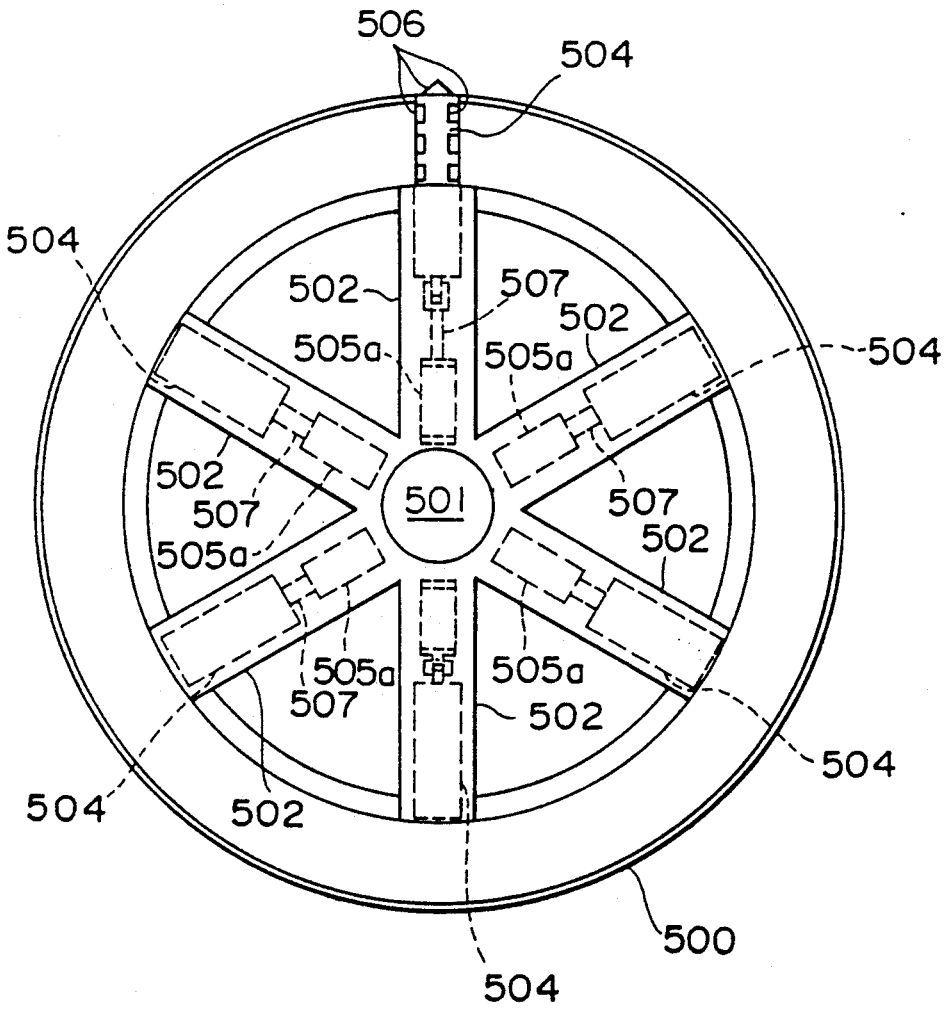

FIGS. 18 and 19 show another embodiment of the subterranean connecting apparatus for the shield tunnel, according to the invention.

The cutter device of the shield machine in this embodiment will be described. The cutter device has a forward end which extends along the central axis of the cylindrical skin plate 500*a* of the shield machine 500 and which projects from the forward section of the skin plate 500*a*. A shaft section (center shaft) 501 is movable in an excavating direction (the direction of the arrow X - Y) along the central axis of the skin plate 500*a*. Six spokes 502, 502, . . . extend radially from the skin plate 500*a* from the forward end of the shaft section 501 to the inward side of the inner peripheral surface of the skin plate 500*a*. A plurality of cutting blades 503, 503, . . . are fixed on the surfaces of the respective spokes 502, 502, . . . . End blades 504 are arranged respectively within the spokes 502. The end blades 504 are extendible and retractible radially to the outer side of the outer peripheral surface of the skin plate 500*a*. The end blades 504 are extendible and retractible to locations inside and outside of the spokes 502 respectively by a plurality of hydraulic devices 505.

Further, a plurality of cutting blades 506, 506, . . . are formed respectively on the tips and the front faces of the end blades 504. A plurality of base ends 506*a* of the respective forward blades 504 are connected respectively to a plurality of hydraulic jacks 505*a* of the hydraulic devices 505 through the shaft bodies 507. The hydraulic devices 505 are composed respectively of the hydraulic jacks 505*a* and power units 505*c* for driving the hydraulic jacks 505*a* respectively lines 505*b*, 505*b*, . . . .

According to the cutter devices constructed as above, by driving the hydraulic devices 505, the end blades 504 have a large degree of expandability and contractibility in the radial direction of the skin plate 500*a* from the inward sides of the inner peripheral surfaces of the respective inner tubes 12 and 22 to the outer sides of the outer peripheral surfaces of the respective outer tubes 11 and 21. Moreover, since the cutters are provided, at their front faces, with excavating blades, excavation is made possible during normal excavation.

Figure 20:
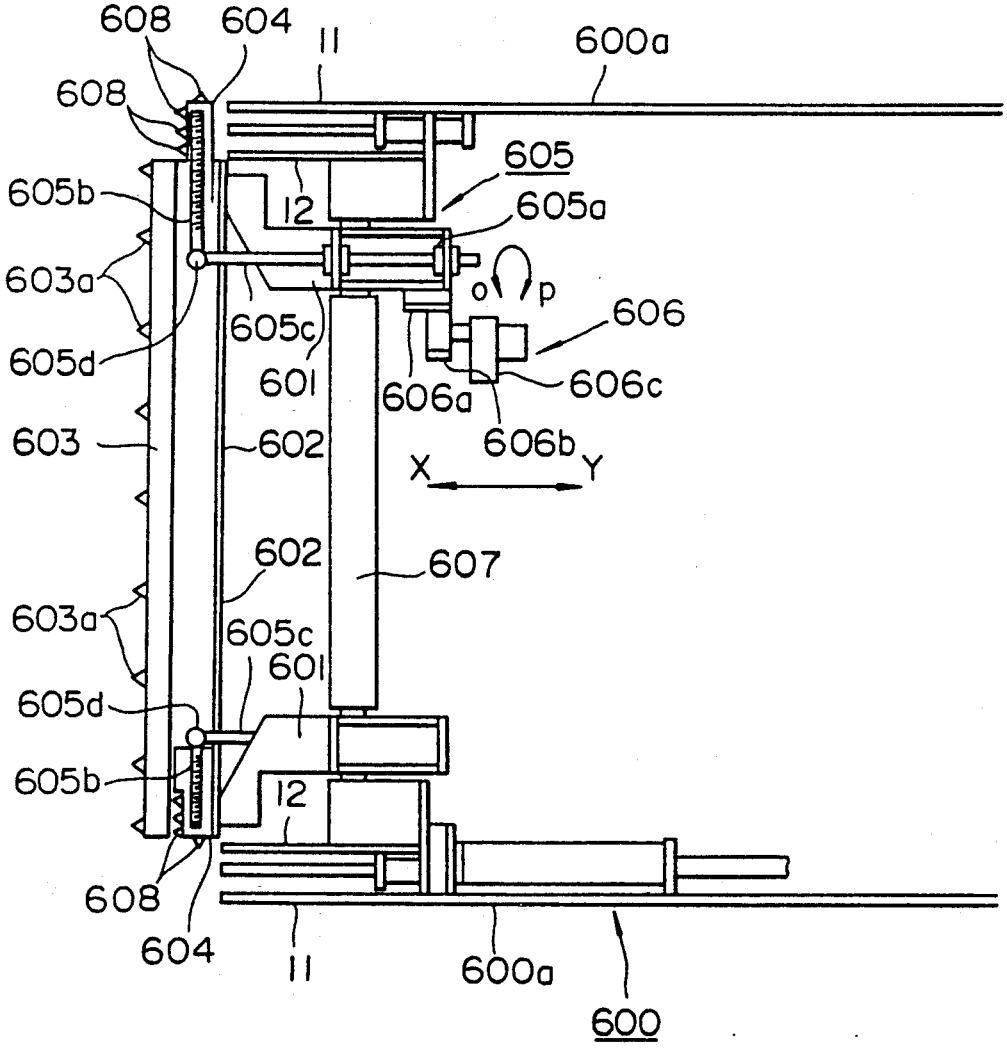
FIG. 20 is a schematic cross-sectional view showing an example of a cutter device in the subterranean connecting apparatus for the shield tunnel, according to the invention.

FIG. 20 shows an example of the cutter device of the subterranean connecting apparatus according to the invention.

As shown in FIG. 20, the shield machine 600 has a cylindrical skin plate 600*a* whose inner peripheral section is provided with a drum-shaped support section 601. The support section 601 has a forward end to which four spokes 602, 602, . . . are fixedly mounted extending radially from the central axis of the skin plate 600*a*. A face plate 603 is fixed on the front sections of the respective spokes 602, 602, . . . . A plurality of cutting blades 603*a*, 603*a*, . . . are arranged on the surface of the face plate 603. A plurality of end blades 604, 604, . . . extendible and retractible in the radial direction of the skin plate 600*a* are provided within the spokes 602. A plurality of drive mechanisms 605 are mounted on the end blades 604, 604, . . . for extending and retraction these blades inside and outside the spokes 602, are mounted on the end blades 604, 604, . . . . Moreover, a drive 606 for rotating the spokes 602 about the axis of the skin plate 600*a* to excavate the ground is provided on the support section 601 of the spokes 602.

The support section 601 is a rotary body formed into a drum shape. The support section 601 is supported rotatably within the skin plate 600*a* by a bearing mechanism, and is movable in the excavating direction (X - Y direction in FIG. 20) of the shield machine 600. A bearing section 605*a* of the drive mechanism 605 for driving the support section 601 is provided within the support section 601 at a location corresponding to the end blade 604. A bulkhead plate 607 is fixedly mounted on the inward side of the inner peripheral surface of the support section 601. Further, the spokes 602 and the face plate 603 are formed to have their respective outer diameters slightly smaller than the inner diameter of the inner tube 12 which is formed at the forward end of the skin plate 600*a*. The plurality of cutting blades 603*a*, 603*a*, . . . arranged radially from the central section are fixedly mounted on the front face side of the face plate 603. Moreover, the end blades 604, 604, . . . are arranged within the spokes 602 which are provided at the rear of the face plate 603 along the cutting blades 603*a*, 603*a*, . . . . A plurality of cutting edges 608, 608, . . . are fixedly mounted on the tips and the front faces of the end blades 604. Female threads in mesh with the bolt sections 605*b* provided respectively at the forward ends of the drive mechanisms 605 are formed in the core sections on the base ends of the end blades 604.

Each of the drive mechanisms 605 is composed of the bearing section 605*a* provided within the support section 601, a shaft body 605*c* supported by the bearing section 605*a*, a gear 605*d* for connecting the shaft body 605*c* to the bolt section 605*b*, and drive means (using a manual operation or a hydraulic device) for rotating the shaft body 605*c* in the O-P direction in FIG. 20. The drive means is used to rotate the shaft body 605*c* to rotate the bolt section 605*b* via the gear 605*d*, and thereby mesh the bolt section 605*b* with the female threads of the forward blade 604. Accordingly, the forward blade 604 is made extendible and retractible in the radial direction of the skin plate 600*a* from the interior of the spoke 602 to the outward side of the outer tube 11 of the skin plate 600*a*. Further, the drive 606 for the face plate 603 is composed of an internal gear 606*a* fixedly mounted on the inner peripheral surface of the support section 601 formed into a drum shape, and an electric motor 606*c* for driving the internal gear 606*a* via an outer gear 606*b* in mesh therewith.

With the cutter device arranged as above, the drive 606 is put into drive and it is thereby possible to greatly extend and contract the forward blade 604 in the radial direction of the skin plate 600*a* from the inward side of the inner peripheral surfaces of the inner tubes 12 and 22 to the outward sides of the outer peripheral surfaces of the respective outer tubes 11 and 21. Since cutting blades are provided also on the front face of the forward blade 604, excavation is also possible during normal excavation. Further, since the end blade 604 is accommodated in the spoke 602 provided at the rearward section of the face plate 603, the face plate 603 can be made simple in structure similarly to the face plate of a shield machine which has generally been used conventionally Moreover, since the base end of the end blade 604 in the cutter device is supported by the drive mechanism 605, there is no risk that the cutter device will contract within the spoke 602 due to excavating resistance during excavation.

FIGS. 21 through 25 show an example of the shield machine in the subterranean connecting apparatus according to the invention.

Figure 21:
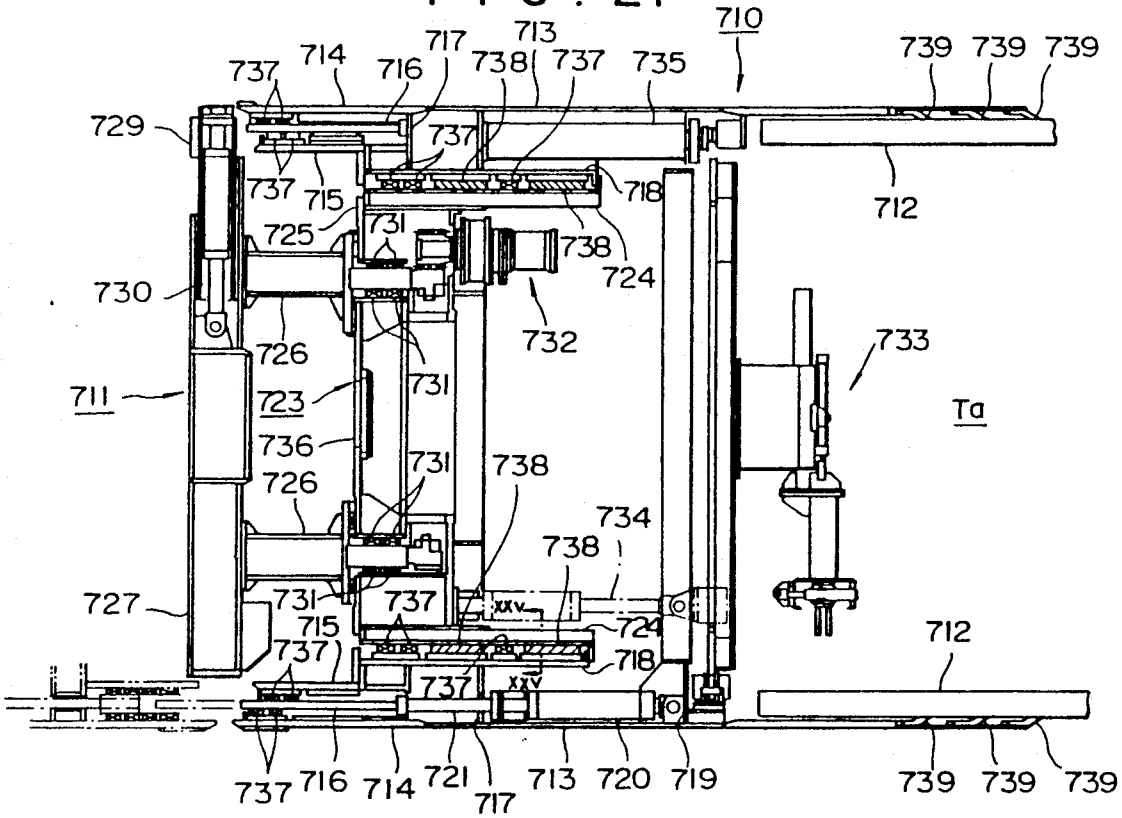
FIGS. 21 through 25 are schematic cross-sectional views showing an example of a shield machine in the subterranean connecting apparatus for the shield tunnel, according to the invention.
Figure 22:
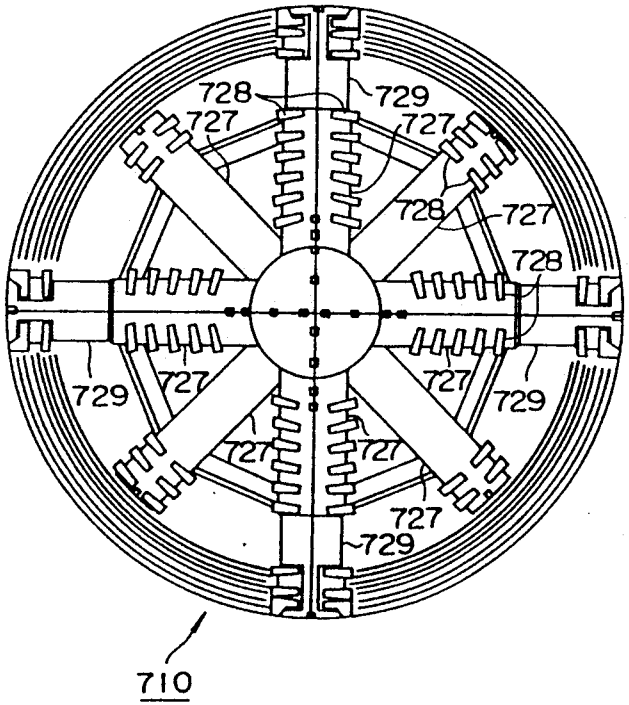
Figure 24:
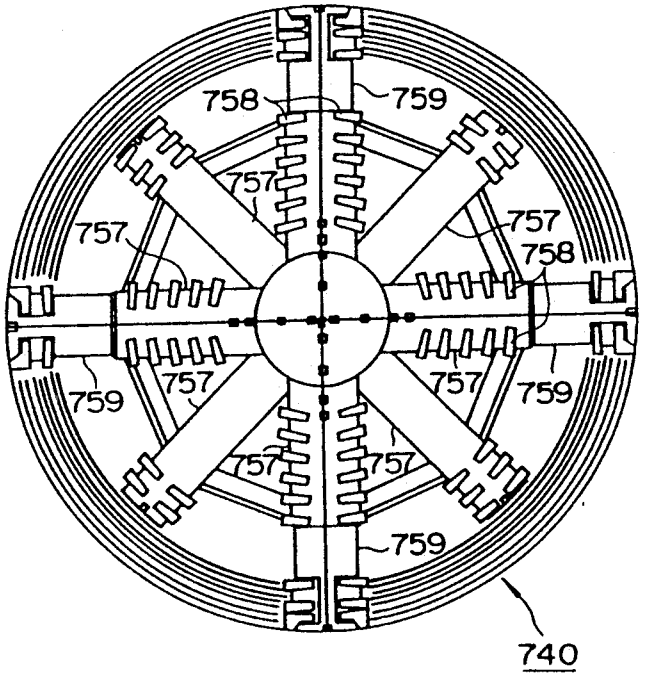
Figure 23:
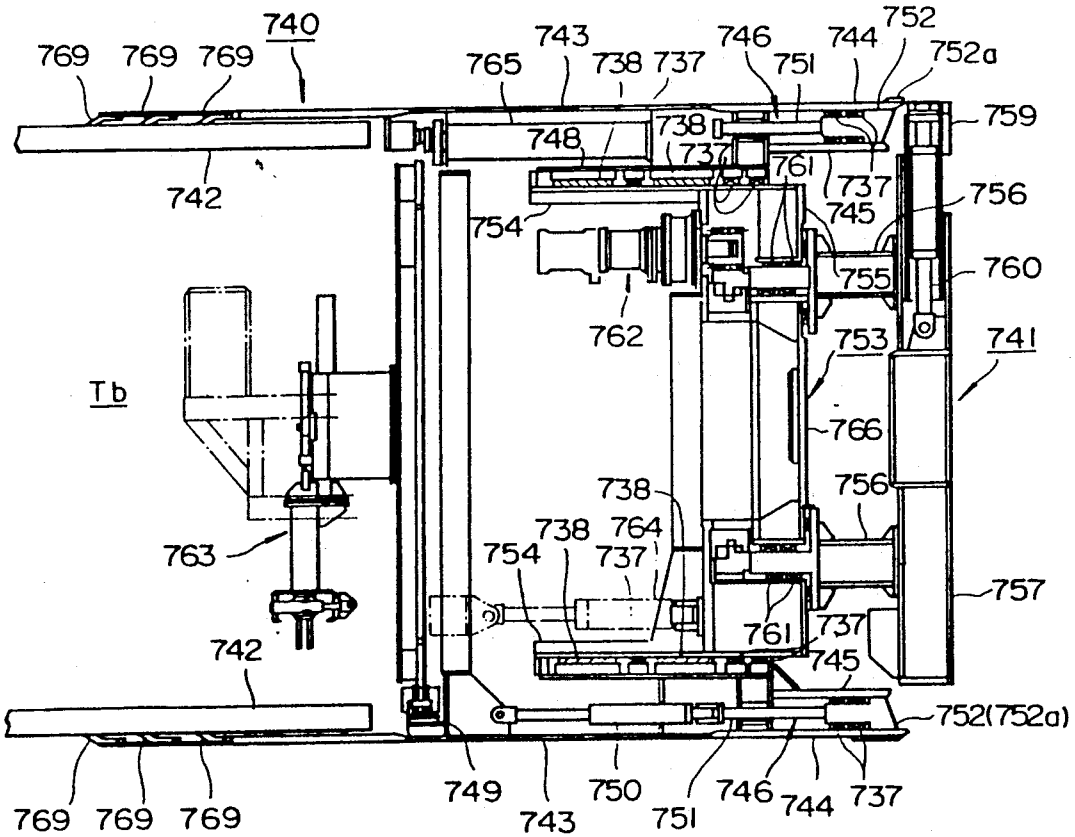

As illustrated in FIG. 21, within the ground G in the vicinity of the connecting section of the shield tunnel, a first shield machine 710 excavates a tunnel section $T_a$ from the right-hand side to the left-hand side using a cutter device 711 which is provided at the front section of the first shield machine 710. Further, as shown in FIG. 23, a second shield machine 740 excavates the other tunnel section $T_b$ from the left-hand side to the right-hand side using a cutter device 741 which is provided at the front section of the second shield machine 740. The tunnel section $T_a$ formed in the rear of the first shield machine 710 has a wall surface which is primarily covered with a plurality of segments 712, 712, . . . assembled within the shield machine 710. Likewise, the tunnel section $T_b$ formed in the rear of the second shield machine 740 has a wall surface which is primarily covered with a plurality of segments 742, 742, . . . assembled within the shield machine 740.

A cylindrical skin plate 713 which forms the outer shell of the first shield machine 710 has a forward end which is formed double by an outer tube 714 formed to have the same diameter as the skin plate 713, and an inner tube 715 formed to have a diameter smaller than that of the outer tube 714. The inner tube 715 is connected to the skin plate 713 by an annular bulkhead plate 717 formed so as to extend perpendicularly to the axis of the skin plate 713. A penetration ring 716 made of steel plate formed into a cylindrical shape is accommodated between the outer tube 714 and the inner tube 715.

Further, in the first shield machine 710, an annular reaction-force plate 719 is mounted on the inner surface of the intermediate section of the skin plate 713. A plurality of (only one shown in the illustrated embodiment) extrusion jacks 720 for extrusion of the penetration ring 716 is mounted on the front face of the reaction-force plate 719 at intervals in the peripheral direction of the reaction-force plate 719. The extrusion jack 720 has a jack rod 721 which passes through the bulkhead plate 717 and extends forward along the axis of the skin plate 713. The forward end of the jack rod 721 is mounted to the rearward end of the penetration ring 716. Moreover, a plurality of seal elements 737, 737, . . . such as lip seal elements or the like are provided on the inner peripheral surface of the outer tube 714 and the outer peripheral surface of the inner tube 715 so as to clamp the penetration ring 716 from both the side faces thereof. By the above construction, the penetration ring 716 is so formed as to be slidable longitudinally along the axis of the skin plate 713.

A tubular attaching tube 718 is mounted on the inner surface of the bulkhead plate 717 coaxially with the skin plate 713. A cylindrical support section 723 having a bottom, the diameter of which is slightly smaller than the attaching tube 718, is fitted in the inner peripheral surface of the attaching tube 718. The support section 723 is composed of a cylindrical sliding tube 724 and a bulkhead plate 725 which closes the forward end of the sliding tube 724. A plurality of slide bearings 738 and 738 and a plurality of seal elements 737 and 737 such as lip seal elements, U-seal elements, O-rings or the like to be interposed between the attaching tube 718 and the sliding tube 724 are provided on the inner peripheral surface of the attaching tube 718. A moving jack 734 for moving the sliding tube 724 is interposed between the bulkhead plate 725 and an elector device 733 for segment assembly provided in the rear of the shield machine 710. Thus, the support section 723 is so formed as to be movable longitudinally along the axis of the skin plate 713. Further, in FIG. 21, the reference numeral 736 denotes a openable hatch which is provided at the center of the bulkhead plate 725.

Meanwhile, the cutter device 711 of the first shield machine 710 is composed of a support drum 726 formed to have a diameter smaller than that of the bulkhead late 725 of the support section 723 and this is supported by the bulkhead plate 725 so as to be concentric with the skin plate 713, and is composed of eight spokes 727, 727, . . . fixedly mounted to the forward end of the support drum 726 and extending radially from the axis of the skin plate 713.

The spokes 727, 727, . . . are formed such that the diameter of a circle passing through the ends thereof is slightly smaller than the inner diameter of the inner tube 715. A plurality of cutting blades 728, 728, . . . are arranged on the front faces of the spokes 727. Further, of the spokes 727, 727, . . . , end blades 729 are accommodated within alternate spokes 727. An extension and retraction mechanism 730 comprising jacks or the like for extending and retracting the end blade 729 in the radial direction of the shield machine 710 and so accommodate and expose the end blade 729 inside and outside the spokes 727 is additionally provided on the end blade 729.

The support drum 726 is supported by the bulkhead plate 725 via a plurality of bearings 731. Further, a drive mechanism 732 such as a hydraulic motor or the like for engaging the rearward end of the support drum 726 to rotatively drive the support drum 726 is mounted on the inner peripheral surface of the sliding tube 724. Thus, the entire cutter device 711 is rotatively driven about a central shaft that is the axis of the skin plate 713.

Figure 25:
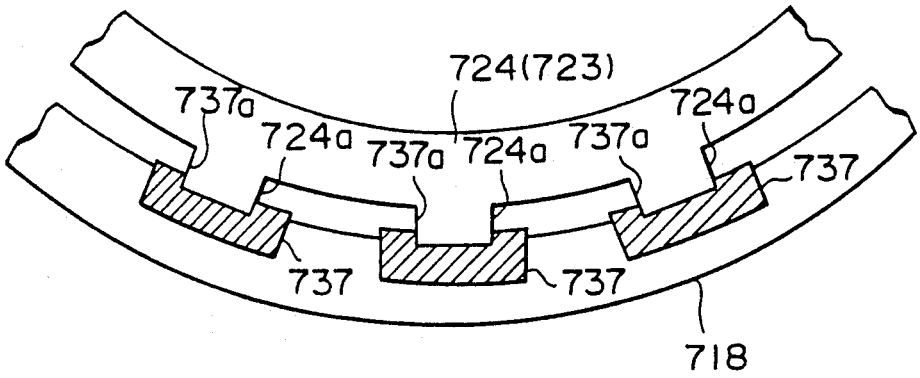
Figure 26:
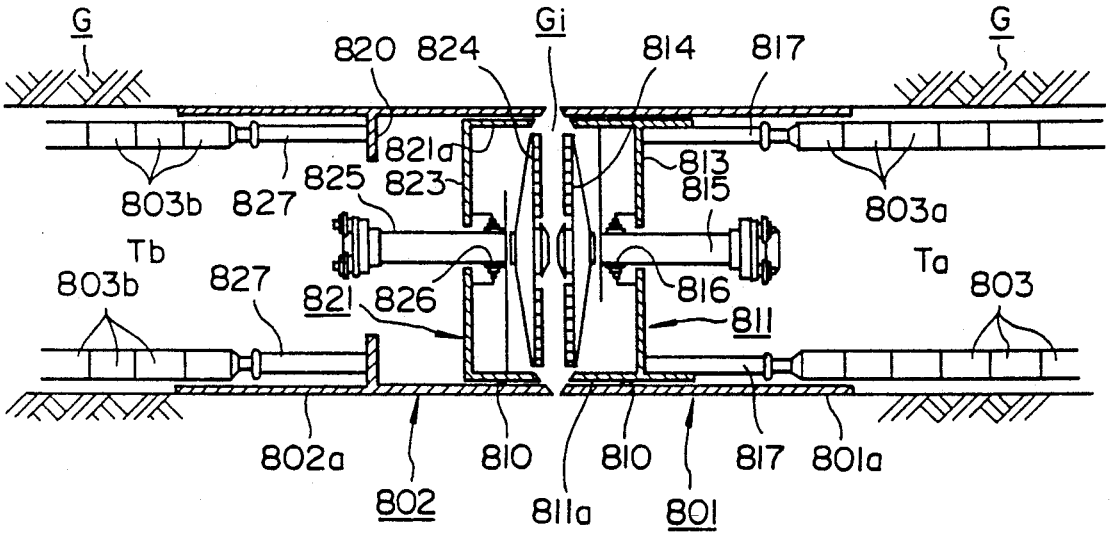
FIGS. 26 through 31 are schematic cross-sectional views for explanation of an embodiment of the subterranean connecting method of construction for the shield tunnel, according to the invention.

In connection with the above, in the first shield machine 710, as shown in FIG. 25, a plurality of projections 724*a* extending along the axis of the skin plate 713 are formed at the rearward end of the sliding tube 724 of the support section 723. A plurality of engaging grooves 737*a* engaged respectively with the projections 724*a* are formed on the seal elements 737 provided on the inner peripheral surface of the attaching tube 718. That is, the sliding tube 724 and the attaching tube 718 are spline-coupled with each other. Thus, it is possible to prevent the sliding tube 724 from being rotated in accompaniment with the rotation of the support drum 726.

On the other hand, the second shield machine 740 is similar in general construction to the first shield machine 710. The forward end of a skin plate 743 is formed double by a cylindrical outer tube 744 having the same diameter as the first shield machine 710 and an inner tube 745. The inner tube 745 is connected to a hollow annular bulkhead plate 748 formed perpendicularly to the axis of the skin plate 743. A space surrounded by the outer tube 744, the inner tube 745 and the bulkhead plate 747 is formed into a penetration chamber 746 in which the penetration ring 716 of the first shield machine 710 will penetrate.

A protection ring 752 is fitted in the penetration chamber 746, and is formed to have its wall thickness slightly smaller than the spacing between the outer tube 744 and the inner tube 745. The protection ring 752 has a front face which is formed with an inclined surface 752*a* inclined rearward toward the center of the shield machine 740. In this way, provision is made for an increase in abutment between the inclined surface 752*a* and the penetration ring 716, and smooth intake of excavated soil. Further, in the second shield machine 740, an annular reaction-force plate 749 is mounted on the inner surface of the intermediate section of the skin plate 743. A plurality of (only one shown in the illustrated example) drawing jacks 750 for drawing in the protection ring 752 are mounted on the front face of the reaction-force plate 749 at intervals in the peripheral direction in the drawing jacks 750. The reaction-force plate 748 have respective jack rods 751 which extend through the bulkhead plate 747 forward along the axis of the skin plate 743. The jack rods 751 have forward ends which are mounted on the rearward end of the protection ring 752. Moreover, a plurality of seal elements 737, 737, . . . such as lip seal elements or the like are provided on the inner peripheral surface of the outer tube 744 and the outer peripheral surface of the inner tube 745 so as to clamp the protection ring 752 from both side surfaces thereof. By the construction described above, the protection ring 752 is so formed as to be slidable longitudinally along the axis of the skin plate 743.

Similarly to the first shield machine 710, the tubular attaching tube 748 is mounted on the inner surface of the bulkhead plate 747 coaxially with the skin plate 743. A cylindrical support section 753 slightly smaller in diameter than the attaching tube 748 and having a bottom is fitted in the inner peripheral surface of the attaching tube 748. Similarly to the support section 723, the support section 753 is composed of a tubular sliding tube 754 and a bulkhead plate 755. A plurality of sliding bearings 738 and 738 and a plurality of seal elements 737 and 737 such as lip seal elements, U-seal elements, O-rings or the like are provided on the inner peripheral surface of the attaching tube 748. A moving jack 764 for moving the sliding tube 754 is interposed between the bulkhead plate 755 and an elector device 763 provided at the rear of the shield machine 740. Thus, the support section 753 is so formed as to be movable longitudinally along the axis of the skin plate 743. Further, the reference numeral 766 in FIG. 23 denotes an openable hatch provided at the center of the bulkhead plate 755.

Meanwhile, similarly to the cutter device 711 of the first shield machine 710, the cutter device 741 is generally composed of a support drum 756 supported by the bulkhead plate 755 of the support section 753, and eight spokes 757, 757, . . . fixedly mounted to the forward end of the support drum 756 and extending radially form the axis of the skin plate 743.

Similarly to the spokes 727 of the first shield machine 710, these spokes 757, 757, . . . are formed such that the diameter of a circle passing through the ends thereof is slightly smaller than the inner diameter of the inner tube 745. A plurality of cutting blades 758, 758, . . . are arranged on the front faces of the spokes 757. Further, of the spokes 757, 757, . . . , forward blades 759 are accommodated within the alternate spokes 757. An extension and retraction mechanism 760 comprising jacks or the like for extending and retracting the end blade 759 in the radial direction of the shield machine 740 and so accommodate and expose the end blades 759 inside and outside the spokes 757 is additionally provided on the end blade 759.

Further, the support drum 756 is supported by the bulkhead plate 755 via a plurality of bearings 761. A drive mechanism 762 such as a hydraulic motor or the like for engaging the rearward end of the support drum 756 to rotatively drive the support drum 756 is mounted on the inner peripheral surface of the sliding tube 754. Thus, the entire cutter device 741 is rotatively driven about a central shaft that is the axis of the skin plate 743.

Similarly to the first shield machine 710, in the second shield machine 740, a plurality of projections extending along the axis of the skin plate 743 are formed at the rearward end of the sliding tube 754 of the support section 753. A plurality of engaging grooves engaged respectively with the projections are formed on the seal elements 737 provided on the inner peripheral surface of the attaching tube 748 Thus, it is possible to prevent the sliding tube 754 from being rotated in accompaniment with the rotation of the support drum 756.

In connection with the above, the reference numerals 735 and 765 in FIGS. 21 and 23 denote propulsion jacks which are provided respectively on the rear surfaces of the bulkhead plates 717 and 747 of the respective shield machines 710 and 740 and which take reaction forces from the forward ends of the respective segments 712 and 742 to propel the shield machines 710 and 740 forward. The reference numerals 739 and 769 designate tail packings which are provided respectively on the inner surfaces of the rearward ends of the skin plates 713 and 743 of the respective shield machines 710 and 740 to close the gaps between the segments 712 and 742 and the skin plates 713 and 743.

According to the shield machines 710 and 740 constructed as above, during tunnel connection, the forward blades 729 and 759 of the respective cutter devices 711 and 741 are retracted to make the diameters to the ends of the respective cutter devices 711 and 741 smaller than the inner diameters of the respective inner tubes 714 and 744, and the moving jacks 734 and 764 are consequently thereby making it possible to accommodate the support sections 723 and 753, in turn, the cutter devices 711 and 741 in the inner tubes 714 and 744. Accordingly, during tunnel connection, it is possible that both the shield machines 710 and 740 approach each other to such a degree that the forward ends of the respective skin plates 713 and 743 of the shield machines 710 and 740 abut against each other. For this reason, it is possible to achieve soil construction and water retarding with respect to the soil and water pressure which acts upon the vicinity of the connecting section from the ground G in the vicinity of the tunnel connection. Thus, the construction of the connecting section of the shield tunnel can safely be executed. Further, unlike a conventional subterranean connecting method construction, there is no need to use an auxiliary method of construction such as a freezing construction method, and it is therefore possible to work on the connecting section without any major construction expenses or construction time being taken up during tunnel connection.

Particularly, in the shield machines 710 and 740 in this embodiment, their cutter devices 711 and 741 are composed respectively of the cylindrical support drums 726 and 756 and the spokes 727 and 757 which are provided respectively at the forward ends of the respective support drums 726 and 756. The shield machines 710 and 740 are so-called intermediate-support-type shield machines in which the support drums 726 and 756 are supported respectively by the cylindrical support sections 723 and 753. Accordingly, as compared with a so-called center-shaft-support-type shield machine in which, for example, spokes are supported by a single center shaft arranged on the axis of the skin plate, it is possible to support the large and heavy spokes, and enlargement in diameter of the shield machines is thereby facilitated. Thus, a sufficient working space is secured at the centers of the respective cutter devices 711 and 741. Accordingly, in an operation such as discharge of conglomerate lodged within a space between the spokes 727 and 757 and the bulkheads 725 and 755 or the like, the working environment is considerably improved.

Further, since the penetration ring 716 is provided at the forward end of the skin plate 713 of the first shield machine 710, it is possible to cover the ground $G_i$ at the connecting section by the penetration ring 716 during tunnel connection. By doing so, it is possible to further achieve soil consolidation and water sealing in the connecting section. Moreover, since the protection ring 752 is provided at the forward end of the skin plate 743 of the second shield machine 740, it is possible to prevent soil and conglomerate from invading in the penetration chamber 746 in which the penetration ring 716 is to be penetrate during normal excavation and so block the penetration chamber 746. Furthermore, even if the penetration chamber 746 is blocked by the soil and the conglomerate, the protection ring 752 is moved longitudinally along the axis of the skin plate 743, thereby making it possible to discharge the soil and the conglomerate from the penetration chamber 746. Thus, smooth penetration of the penetration ring 716 is made easy.

FIGS. 26 through 31 show an embodiment of the subterranean connecting method of construction according to the invention.

The construction of a pair of shield machines used in the connecting method of construction in this embodiment will first be described.

Figure 30:
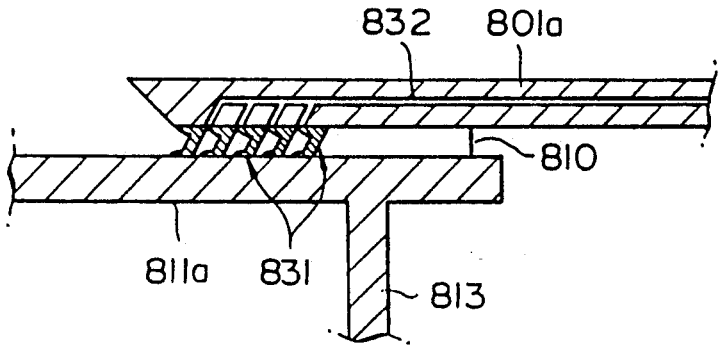

A first shield machine 801 is composed of a first outer skin plate 801*a* formed into a cylindrical shape, and a first machine body 811 which forms a predetermined gap 810 within the first outward skin plate 801*a* and which is slidable axially. In the first machine body 811, the frame is composed of a first skin plate 811*a* formed into a cylindrical shape and a disc-shaped bulkhead plate 813 which is fixedly mounted to the interior of the first skin plate 811*a* perpendicularly thereto. The frame has a forward section where a first cutter device 814 is provided. A shaft body 815 of the first cutter device 814 is supported by the bulkhead plate 813 via a bearing section 816 having a seal mechanism. A plurality of first propulsion jacks 817 are fixedly mounted to the rearward surface (on the side of the tunnel section $T_a$) of the partition plate 813 in the peripheral direction thereof. Further, water sealing means such as a lip seal element 831 or the like made of urethane as shown in, for example, FIG. 30 is provided at the gap 810 between the first outer skin plate 801*a* and the first skin plate 811*a*. During excavation, grease or the like is supplied to the gap 810 by an oil injection tube 832 which extends through the interior of the first outer skin plate 801*a* and which opens into the gap 810, to prevent water or the like from invading the gap 810. The first outer skin plate 801*a* and the first skin plate 811*a* are so formed as to be fixedly mounted to each other by fixing means (not shown) at normal excavation so that the first outer skin plate 801*a* and the first skin plate 811*a* moved in an integrated manner.

On the other hand, the second shield machine 802 is composed of a second outer skin plate 802*a* formed into a cylindrical shape having the same diameter as the first outer skin plate 801*a* and a second machine body 821 which forms a predetermined gap 810 within the second outer skin plate 802*a* and which is slidable axially. The second machine body 821 has a frame which is composed of a second skin plate 821*a* formed into a cylindrical shape and a disc-shaped bulkhead plate 823 which is fixedly mounted to the rearward end of the second skin plate 821*a* perpendicularly thereto. A second cutter device 824 is provided in the front section of the frame. The second cutter device 824 has a shaft body 825 which is supported by the bulkhead plate 823 via a bearing section 826 having a seal mechanism.

Figure 31:
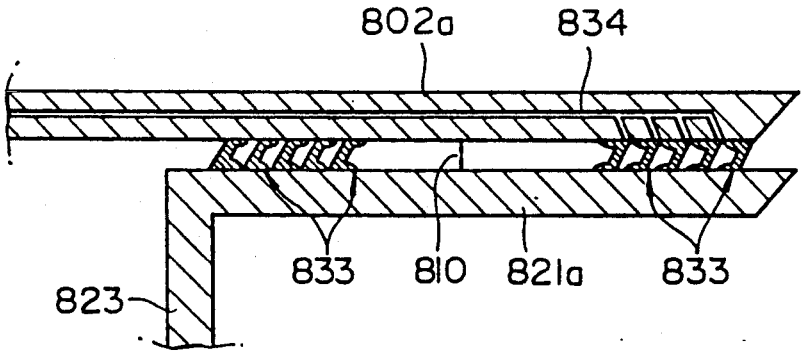

The second outer skin plate 802*a* has, at the intermediate section of the inner peripheral surface, an auxiliary skin plate ring 820. A plurality of propulsion jacks 827 are mounted on the rearward surface (on the side of the tunnel section $T_b$) of the auxiliary skin plate ring 820 in the peripheral direction. The second machine body 821 and the second outer skin plate 802*a* are fixedly mounted to each other, and the jacks 827 are operated to push the auxiliary skin plate ring 820, and the second shield machine 802 can thereby be moved forward. Further, similarly to the first shield machine 801, a water sealing means such as a lip seal element 833 or the like as shown in FIG. 31 is also provided in the second shield machine 802 in the gap 810 between the second outer skin plate 802*a* and the second skin plate 821*a*. Moreover, an oil supply tube 834, which opens into the gap 810, is provided within the second skin plate 802*a*. The outer skin plate 802*a* and the second skin plate 821*a* are so formed as to be fixedly mounted to each other by fixing means (not shown) at normal excavation so that the outer skin plate 802*a* and the second skin plate 821*a* moved in an integrated manner.

An embodiment of the subterranean connecting method of construction using the shield machines 801 and 802 constructed as above will next be described with reference to FIGS. 26 through 29.

(i) The first shield machine 801 is first used to excavate the ground G from the right-hand side with respect to the drawing sheet using the first cutter device 814, to form a single tunnel. The wall surface of the excavated hole is covered with the segments 803*a*. Reaction forces from the segments 803*a* are taken to operate the first propulsion jacks 817 thereby constructing the one tunnel section $T_a$. The second shield machine 802 is used to excavate the ground G from the left-hand side using the second cutter device 824. The wall surface of the excavated hole is covered with the segments 803*b*. Reaction forces from the segments 803*b* are taken to operate the second propulsion jacks 827, thereby constructing the other tunnel section $T_b$. At the connecting section, the first shield machine 801 and the second shield machine 802 face toward each other, with the ground $G_i$ having a predetermined length (about 0.3 m) remaining.

(ii) The fixing means between the outer skin plate 801*a* of the first shield machine 801 and the first machine body 811, and the fixing means between the outer skin plate 802*a* of the second shield machine 802 and the second machine body 821 are next released.

Figure 27:
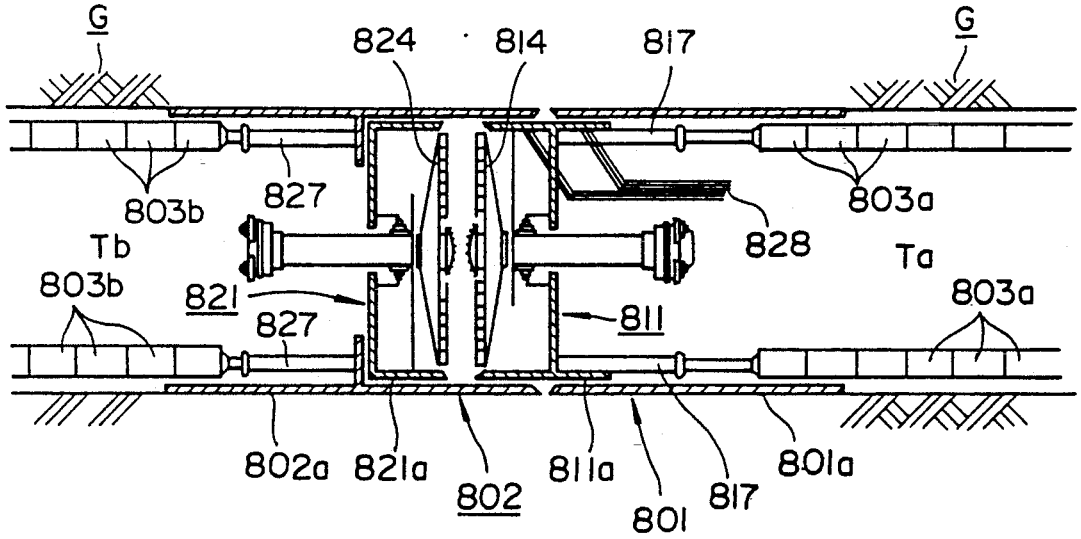

(iii) Next, as shown in FIG. 27, under such a condition that the first outer skin plate 801*a* and the second outer skin plate 802*a* are maintained as they are, the second machine body 821 is moved rearward to a location where it abuts against the auxiliary skin plate ring 820, while the skin plate 821*a* of the second machine body 821 slides with respect to the second outer skin plate 802*a*. Simultaneously, the first machine body 811 is moved forwardly, while the skin plate 811*a* of the first machine body 811 slides with respect to the first outer skin plate 801*a*. The forward moving operation of the first machine body 811 is performed by driving the first cutter device 814 and operation of the propulsion jack 817. Thus, the ground $G_i$ remaining between the two shield machines is excavated.

(iv) When the skin plate 811*a* of the first machine body 811 has been slidingly moved so that the skin plate 811*a* just straddles the gap between the first outer skin plate 801*a* and second outer skin plate 802*a* to reach a position closing the gap, the forward movement of the first machine body 811 stops, and the grout agents are injected into the gap 810 formed between first skin plate 811*a* and the first outer skin plate 801*a* and the second outer skin plate 802*a* by injection tubes 828, to effect water sealing.

Figure 28:
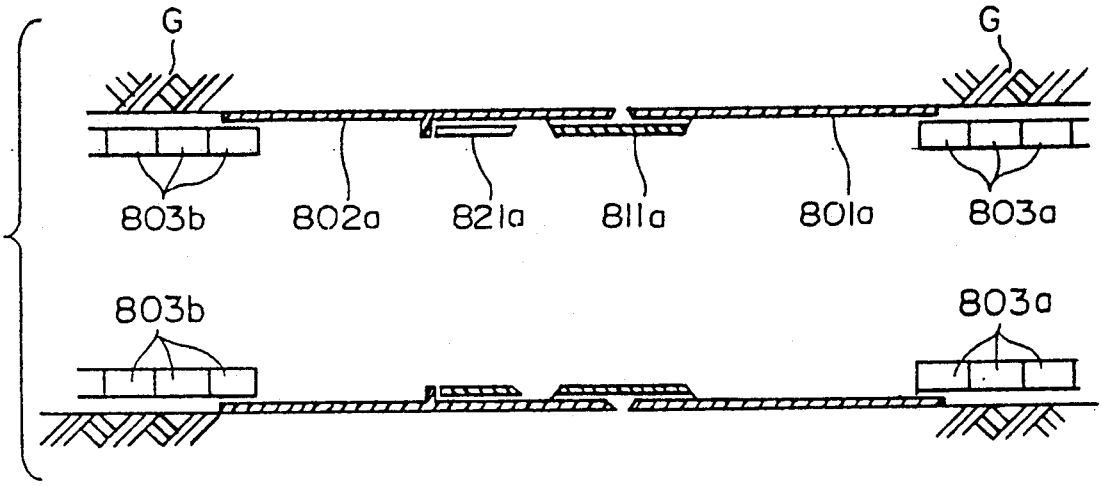

(v) Next, as shown in FIG. 28, the first machine body 811 and the second machine body 821 are disassembled under such a condition that the first skin plate 811*a* and the second skin plate 821*a* remain as they are. Simultaneously, the first and second propulsion jacks 817 and 827 are also disassembled. By doing so, the tunnel section $T_a$ and the tunnel section $T_b$ pass through each other to from a single tunnel.

(vi) Subsequently, the both ends of the first skin plate 811*a*, which remains under such a condition that the gap formed between the first skin plate 801*a* and to the second outer skin plate 802*a* is covered from its inward side, are welded to the first outer skin plate 801*a* and the second outer skin plate 802*a* from their inward sides and are fixedly mounted thereto. By doing so, the first skin plate 811*a* just serves as a lap joint in the form of a sleeve.

Figure 29:
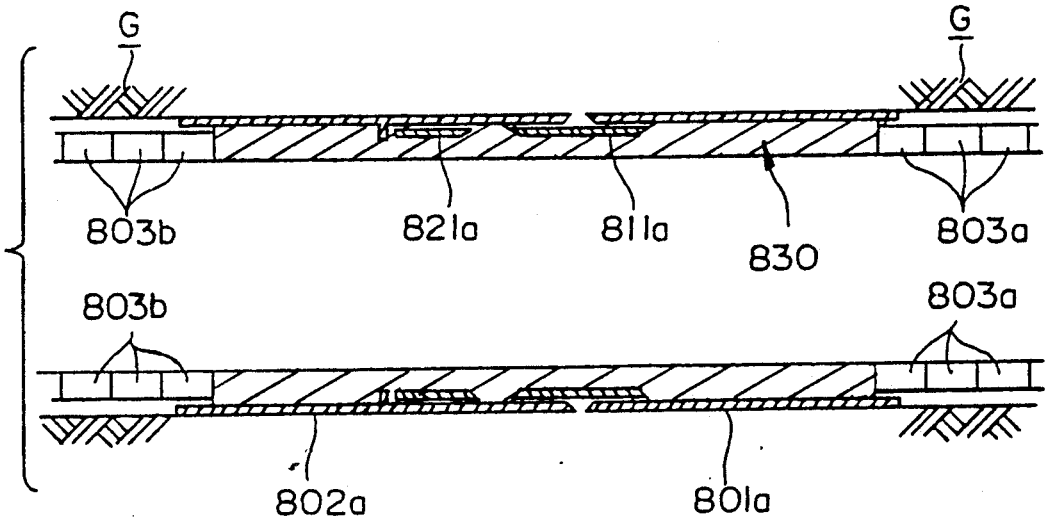

(vii) Lastly, as shown in FIG. 29, concrete 830 is placed onto the wall surfaces on the inward sides of the respective skin plates, to complete execution of the connecting section.

According to the subterranean connecting method of construction, it is possible to close the gap formed between the first outer skin plate 801*a* and the second outer skin plate 811*a* from the inward side of the gap by the first inner skin plate 811*a*. Thus, water sealing at the tunnel connecting section can be achieve easily and reliably.

In the subterranean connecting method for construction of the shield tunnel and its connecting apparatus, two shield machines are used to simultaneously excavate a single tunnel from both ends thereof. When the tunnel sections constructed respectively by the shield machines are connected to each other, it is possible to achieve sealing and water sealing with respect to soil water pressure acting upon the vicinity of the connecting section. Thus, the safety of the tunnel construction can be improved.

What is claimed is:

1. A subterranean connecting method for a shield tunnel, said subterranean connecting method employing two shield machines which are propelled underground while cutter devices of said shield machines excavate earth in proximity thereto such that said cutter devices are provided at the foremost sections of said shield machines and include cutter sections which are extendable and retractable in a radial direction, said subterranean connecting method applicable to excavating a subterranean tunnel by starting at each end of a tunnel to be constructed and progressively excavating underground from each end of said tunnel until said shield machines meet at some point intermediate between each end of said subterranean tunnel, said subterranean connecting method comprising:

a step of assembling segments for a primary conveying in excavated portions, a step of excavating the tunnel by a set of a first shield machine having a skin plate whose forward end is formed double by an outer tube and an inner tube, in which a penetration ring is accommodated within a penetration ring chamber formed between said outer tube and said inner tube, and of a second shield machine having a skin plate whose forward end is formed double by an outer tube and an inner tube with diameters which are the same as for said first shield machine, a penetration chamber which is formed between said outer tube and inner tube so that said penetration ring penetrates therein, a protection ring arranged within said penetration chamber; being movable longitudinally with respect to said second shield machine, at least one injection tube in which the distal opening end is opened within an end portion of said penetration chamber, and injection bores formed in said protection ring, extending longitudinally of said second shield machine;

a step wherein said penetration ring is made to penetrate into said penetration chamber by sliding the penetration ring of said first shield machine forward the axis of said first shield machine just before completion of said tunnel excavation thereby covering the ground at the tunnel connecting section remaining between said first and second shield machines by said penetration ring, a step wherein said protection ring is slid rearwardly in said penetration chamber when said penetration ring slides forward, a step of injecting and filling water retarding material into said penetration chamber by said at least one injection tube at least before said protection ring is slid rearwardly, a step wherein before the penetration ring is made to penetrate into said penetration chamber, retracting said extendable and retractable cutter sections to reduce the diameter of the cutter devices so that the penetration ring may pass therearound, and a step of dissembling said first and second shield machines after said step has been completed while the skin plates of said respective first and second shield machines remain as they are, thereby excavating the ground at the connecting section.

2. The subterranean connecting method for the shield tunnel, according to claim 1, characterized in that, when the penetration ring of the said first shield machine penetrates into the penetration chamber of the second shield machine to make the connection, soil and conglomerate clogged within the penetration chamber is blasted by a high-pressure jet.

3. The subterranean connecting method for the shield tunnel, according to claim 2 characterized in that, when said penetration ring penetrate into the penetration chamber, the said penetration ring is inserted while injecting the high-pressure jet from the forward end of the said penetration ring.

4. The subterranean connecting method for the shield tunnel, according to claim 2, characterized in that the high-pressure jet is injected from the back of the said penetration chamber to secure a space within the penetration chamber and, subsequently, the said penetration ring is inserted into the penetration chamber.

5. The subterranean connecting method for the shield tunnel, according to claim 1, characterized in that a hollow elastic element formed into a ring shape is provided within the said penetration chamber, in that, when the penetration ring penetrate into the said penetration chamber, fluid such as air, water, oil or the like is forcibly delivered into the said hollow elastic element to inflate the hollow elastic element, and in that the inflated hollow elastic element is in close contact over the entire periphery of the forward end of the said penetration ring.

6. A subterranean connecting method for a shield tunnel, in which two shield machines are used which are propelled in the earth while the ground is excavated by cutter devices provided respectively in the front sections of the shield machines and while segments for a primary covering are assembled inside, tunnel sections from both ends of the tunnel to be constructed and are connected to each other in mid course thereby completing the tunnel, comprising the steps of excavating the tunnel by a set of two shield machines having their respective skin plates, the forward ends of which are formed double by an outer tube and an inner tube, the step in which the inner tube of one of the said two shield machines is moved backwards and the inner tube of the other shield machine is moved forwards while excavating the ground at a connecting section just before completion of the said tunnel excavation step, thereby closing the outer tubes of the respective two shield machines by the forwardly moved inner tube, and disassembling the two shield machines while the skin plates of the respective shield machines remain after completion of the moving step.

7. A subterranean connecting method for a shield tunnel, in which two shield machines which are propelled in the earth while the ground is excavated by cutter devices provided respectively in the front sections of the shield machines and while segments for a primary covering are assembled inside are used to excavate tunnel sections from both ends of the tunnel to be constructed and are connected to each other in mid-course thereby completing the tunnel, comprising the step of excavating the tunnel from both ends thereof by a set of a first shield machine having a first skin plate whose forward end is formed with a fitting projection, and having a first cutter device whose end blade is contractibly formed so as to be capable of being accommodated within the said fitting projection, and a second shield machine having a second skin plate whose forward end is formed, at its inner side, with a fitting recess in which the said fitting projection is fitted, and having a second cutter device whose end blade is so formed as to be retractible similarly to said first cutter device, and then the end blades of the said first and second cutter devices are retracted when the tunnel sections are connected to each other, to fit the said fitting projection in the fitting recess, thereby connecting the said first skin plate and the said second skin plate to each other to screen the connecting section from the surrounding ground and, subsequently, the shield machines are disassembled while the skin plates of the respective first and second shield machines reman as they are.

8. A shield machine comprising a set of shield machines whose respective forward sections are provided respectively with cutter devices, wherein said shield machine comprises:

a first shield machine in which the forward end of a skin plate is formed double by an outer tube and an inner tube, and in which a penetration ring is accommodated within a penetration ring chamber formed between said outer tube and said inner tube, and a second shield machine in which the forward end of a skin plate is formed double by an outer tube and an inner tube with the same diameters as for said first shield machine and in which a penetration chamber which is penetrated by said penetration ring is formed, a protection ring arranged within said penetration chamber of said second shield machine, said protection ring being movable longitudinally of said second shield machine to prevent soil or conglomerate from invading said penetration chamber or to discharge excavated soil or conglomerate within said penetration chamber, at least one injection tube in which the distal opening end is opened within an end portion of said penetration chamber of said second shield machine in order to injection water retarding material within said penetration chamber of said second shield machine, injection bores formed in said penetration ring, extending longitudinally of said second shield machine;

said cutter devices of said first and second shield machines have cutter sections, said cutter section being movable along spokes which are provided radially from the rotation center of said respective cutter device so as to be extendable and retractable in the radial direction of said respective cutter device.

9. The shield machine according to claim 8, characterized in that the said penetration chamber has a high-pressure jet nozzle for blasting the soil, conglomerate and the like clogged within the penetration chamber, by a high pressure jet.

10. The shield machine according to claim 8, characterized in that a high-pressure jet nozzle is provided at a forward end of the said penetration ring for blasting the soil, conglomerate and the like clogged within the penetration chamber.

11. The shield machine according to claim 8, characterized in that a ring-shaped hollow elastic element is provided within said penetration chamber, wherein, when the penetration ring is penetrated in the penetration chamber, fluid such as air, water, oil or the like has forcibly delivered into a hollow section of the hollow elastic element to inflate the same, thereby tightly closing the forward end of the said penetration ring over the entire periphery thereof.

12. The shield machine according to claim 8, characterized in that the said first shield machine has a first skin plate having its forward end formed with a fitting projection and has a first cutter device whose end blade is contractibly forward so as to be accommodated within said fitting projection, and in that the said second shield machine has a second skin plate whose forward end has an inner side in which is formed a fitting recess which fits with the said fitting recess, and has a second cutter device whose end blade is so formed as to be contractible similarly to the said first cutter device.

13. The shield machine according to claim 8, characterize in that it comprises a support section provided within the said skin plate, spokes fixed to the forward end of the said support section, a face plate fixed to the front sections of the spokes and having a surface provided with cutting blades, end blades arranged within the said spokes and extendible and retractible from inside the spoke to out side the outer diameter of the skin plate, a drive mechanism for extending and retracting the said end blade inside and outside the said spoke, and drive device for rotating the support section of the said face plate within the skin plate.

14. The shield machine according to claim 13, characterized in that a cutting blade is also formed on the front face of the said end blade.

* * * * *

UNITED STATES PATENT AND TRADEMARK OFFICE

CERTIFICATE OF CORRECTION

PATENT NO. : 5,221,160

DATED : June 22, 1993

INVENTOR(S) : Youji Azuma, et al

It is certified that error appears in the above-indentified patent and that said Letters Patent is hereby corrected as shown below:

Column 1, line 48: after "disassembled" insert --.--

Column 9, line 32: "a" should read --as--

Column 18, lines 21-22: after "conventionally" insert --.--

Column 21, line 39: after "748" insert --.--

Column 24, line 38: after "and" insert --the--

Column 25, lines 31-32, Claim 1: "conveying" should read --covering--

Column 26, line 6, Claim 1: "dissembling" should read --disassembling--

Column 27, line 25, Claim 7: "reman" should read --remain--

Column 28, lines 41-42, Claim 13: "characterize" should read --characterized--

Signed and Sealed this

Twenty-second Day of March, 1994

*Attest:*

Bruce Lehman

BRUCE LEHMAN

*Attesting Officer*

*Commissioner of Patents and Trademarks*